US006904982B2

(12) United States Patent
Judge et al.

(10) Patent No.: US 6,904,982 B2
(45) Date of Patent: Jun. 14, 2005

(54) SUBSEA MUD PUMP AND CONTROL SYSTEM

(75) Inventors: Robert A. Judge, Houston, TX (US); Dat Manh Nguyen, Houston, TX (US); Harold Wade, Houston, TX (US); Ronald D. Brooks, Houston, TX (US)

(73) Assignee: Hydril Company, Houston, TX (US)

( * ) Notice: Subject to any disclaimer, the term of this patent is extended or adjusted under 35 U.S.C. 154(b) by 0 days.

(21) Appl. No.: 10/341,511

(22) Filed: Jan. 13, 2003

(65) Prior Publication Data

US 2004/0007392 A1 Jan. 15, 2004

Related U.S. Application Data

(63) Continuation-in-part of application No. 09/923,287, filed on Aug. 6, 2001, now Pat. No. 6,505,691, which is a continuation-in-part of application No. 09/276,404, filed on Mar. 25, 1999, now Pat. No. 6,325,159.

(60) Provisional application No. 60/079,641, filed on Mar. 27, 1998.

(51) Int. Cl.[7] ..... E21B 15/02; F04B 17/00

(52) U.S. Cl. ..... 175/213; 175/217; 175/7; 166/84.4; 417/392

(58) Field of Search ..... 175/7, 213, 217, 175/218; 166/374, 84.4, 105, 105.4; 417/392, 521, 390, 395

(56) References Cited

U.S. PATENT DOCUMENTS 2,419,993 A * 5/1947 Green et al. ..... 417/344
2,703,055 A * 3/1955 Jan et al. ..... 417/205
2,723,681 A * 11/1955 Macglashan, Jr. et al. ..... 137/625.65
2,854,998 A * 10/1958 MacGlashan, Jr. et al. . 137/550
3,929,014 A * 12/1975 Sharki ..... 73/168
4,611,973 A * 9/1986 Birdwell ..... 417/342
5,616,009 A * 4/1997 Birdwell ..... 417/342
6,102,673 A * 8/2000 Mott et al. ..... 417/392

* cited by examiner

*Primary Examiner*—Frank Tsay
(74) *Attorney, Agent, or Firm*—Osha & May LLP

(57) ABSTRACT

A sub-sea mud pump system includes a plurality of pump units, and each pumping unit includes a plurality of pumping elements. Each pumping element includes a pressure vessel with a first and a second chamber, a separating member between the first and second chambers, a measurement device adapted to measure the volume of at least one of the first and second chambers, a hydraulic inlet control valve and a hydraulic outlet control valve coupled to the first chamber, a mud suction valve and a mud discharge valve coupled to the second chamber. The first chamber is hydraulically coupled to receive and discharge a hydraulic fluid, and the second chamber is hydraulically coupled to receive and discharge a drilling fluid. The separating member is adapted to move within its the pressure vessel in response to a pressure differential between the first and second chambers. The pump system also includes a hydraulic control unit adapted to control the plurality of pump units.

23 Claims, 12 Drawing Sheets

SUBSEA MUD PUMP AND CONTROL SYSTEM

CROSS REFERENCE TO RELATED APPLICATIONS

This is a continuation in part of U.S. patent application Ser. No. 09/923,287 filed on Aug. 6, 2001 and assigned to the assignee of the present invention, and issued as U.S. Pat. No. 6,505,691. Application Ser. No. 09/923,287 is a continuation-in-part of U.S. patent application Ser. No. 09/276,404 filed on Mar. 25, 1999 and assigned to the assignee of the present invention; which claims the benefit of U.S. Provisional Patent Application Ser. No. 60/079,641, filed on Mar. 27, 1998.

BACKGROUND OF INVENTION

1. Field of the Invention

The invention relates generally to offshore drilling systems which are used to drilling subsea wells. More particularly, the invention relates to a subsea pump and an associated control system for use in offshore drilling systems.

2. Background Art

In conventional offshore drilling operations from, for example, a floating drilling vessel, a large diameter marine riser (e.g., a 21 inch marine riser) generally connects surface drilling equipment on the floating drilling vessel to a blowout preventer stack connected to a subsea wellhead located on the seabed. The marine riser is generally filled with drilling fluid (or "drilling mud") so that a total hydrostatic pressure on a formation being drilled in a wellbore is determined by the hydrostatic pressure of the mud in the drilled wellbore (below the seabed) plus the hydrostatic pressure of the mud in the marine riser (above the seabed). In many cases, the total hydrostatic pressure of the "mud column" may exceed a fracture pressure of the formation being drilled. Accordingly, a large number of casing strings may need to be placed in the wellbore to protect the formation and maintain well control. In deep water drilling operations, the total cost of installing a large number of casing strings, combined with smaller oil and gas production rates possible through reduced diameter casing, can often result in wells which are uneconomical to drill and produce.

It has been determined that an important aspect of improving the economics and well control of deep water wells lies in reducing the hydrostatic pressure of the mud in the marine riser to that of a column of seawater, while at the same time filling the wellbore with drilling mud of sufficient weight to maintain well control. Various concepts have been presented in the past for achieving this goal, and the concepts can be grouped into two categories: mud lift drilling with a marine riser and riserless drilling.

Mud lift drilling with a marine riser typically includes a dual density mud gradient system, and the density of the mud return in the riser is generally reduced so that the hydrostatic pressure of the mud column in the riser, measured at the seabed, more closely matches that of seawater. The mud in the well bore remains weighted at a higher density to maintain proper well control. For example, U.S. Pat. No. 3,603,409 issued to Watkins et al. and U.S. Pat. No. 4,099,583 issued to Maus both disclose methods of using injected gas to reduce the density of the mud column in the marine riser, thereby reducing the hydrostatic pressure of the mud in the marine riser as measured at the seabed.

Riserless drilling generally includes eliminating the riser as a mud return path and replacing it with one or more small diameter mud return lines. For example, U.S. Pat. No. 4,813,495 issued to Leach discloses a system that eliminates the need for the marine riser and, as an alternative, uses a centrifugal pump to lift mud returns from the seafloor to the surface through a mud return line. A rotating apparatus isolates the mud in the wellbore annulus from seawater as the drillstring is run into and out of the wellbore.

U.S. Pat. No. 6,102,673, issued to Mott et al. and assigned to the assignee of the present invention, discloses a dual gradient riserless drilling system that uses a pressure actuated drillstring valve to control mud free fall, rotating and non rotating subsea diverters to isolate the mud in the wellbore from fluids, such as seawater, above the wellbore, a solids control system to control the size of solids in mud return lines, and a subsea positive displacement pump actively controlled in a coordinated manner with surface equipment on a drilling vessel to maintain the volume of mud in the wellbore.

Generally, the riserless drilling is preferred over the mud lift system because riserless drilling employs a pressure barrier between the wellbore and the surrounding environment. The pressure barrier allows the wellbore to be drilled in an "underbalanced" condition where formation pressures typically exceed the pressure of the drilling mud in the wellbore. Underbalanced drilling may significantly improve the rate of penetration of a drill bit and also helps reduce the risk of formation damage.

U.S. Pat. No. 6,102,673 issued to Mott et al discloses a subsea positive displacement pump with multiple pump elements, each pump element comprising a pressure vessel divided into two chambers by a separating member and powered by a closed hydraulic system using a subsea variable displacement hydraulic pump. The subsea positive displacement pump includes hydraulically actuated valves to ensure proper valve seating in the presence of, for example, cuttings from the drill bit that are present in mud returns from the wellbore. The hydraulically actuated valves also provide flexibility in valve timing (which is typically not available with conventional spring biased check valves) and provide quick valve response in high flow coefficient (Cv) arrangements necessary for high volume pumping (e.g., substantially high flow rates).

The subsea positive displacement pump disclosed in U.S. Pat. No. 6,102,673 issued to Mott et al is controlled by a unitary control module which receives the following signals: (1) position signals from a position indicator on the separating member in each pump element, wherein the position signals are converted into volume measurements; (2) flow and pressure signals from devices on a return side of the closed hydraulic system; (3) flow signals from a supply side of the hydraulic system (usually positioned proximate the variable displacement hydraulic pump); and (4) pressure signals from a mud suction pressure transducer.

Control signals from the control module: (1) control the operation of the flow control valve on the hydraulic fluid return to ensure that the flow rate from the variable displacement hydraulic pump is equal to the flow rate returning to the hydraulic reservoir; (2) operate the two hydraulic control valves and two hydraulically actuated mud valves on each pumping element to control the pumping rate of the subsea mud pump; and (3) control the flow rate of the variable displacement hydraulic pump. The control module algorithm is designed to provide "pulsationless" flow by precisely controlling the "phasing" of the multiple pumping elements to overlap both the fill and discharge cycles of the pumping elements.

The control system is difficult to precisely adjust because it has proven difficult to accurately model both the non-linear responses of many of the hydraulic components of the system and the wellbore hydraulic characteristics over time. In practice, significant load changes from a stable pump operating condition, such as step load changes of plus or minus fifty percent, have been found to cause instability in the system. Further, the response of the variable displacement hydraulic pump to the control signals, which is adequate at low and steady pumping rates, has proven to be inadequate at higher mud pump rates (e.g., pump rates above about 4–5 strokes per minute).

The subsea pump disclosed in U.S. Pat. No. 6,102,673 issued to Mott et al generally requires that the hydraulic power source be located proximate the subsea mud pumping elements with high flow capacity (e.g., high Cv piping between the hydraulic pump and the mud pumping elements) to minimize lag in the hydraulic response. This precludes, for example, using high pressure pumps located on the floating rig as a source of hydraulic power. Moreover, because the hydraulic valves controlling the mud pumping elements in the disclosed arrangement must have a high Cv to allow the mud pumps to operate at high flow rates, the disclosed control valve arrangement may be prone to hydraulic "water hammer" effects whenever the large bore valves open or close under differential pressure during the pumping cycle, especially at high pump rates.

It would be advantageous, therefore, to design a subsea mud pump and a coordinated control system that would enable stable, efficient operation of deep water drilling systems, including riserless drilling systems. It would also be advantageous to design a control scheme that insures that bottom hole pressure (BHP) is maintained whenever drilling mud pumps are stopped, for example, to add lengths of drillpipe to the drillstring (e.g., when "making a connection").

Finally, it would be advantageous to design a control system that can compensate for drilling mud that has some degree of compressibility, whether because of the high hydrostatic pressures encountered in deepwater subsea operations (e.g., at depths of 10,000 feet, fresh water exhibits compressibility on the order of 2.5–3%) or because of entrained gas or volatile liquids/hydrocarbons that may be present in the drilling mud leaving the wellbore.

SUMMARY OF INVENTION

In one aspect, the invention relates to sub-sea mud pump system includes a plurality of pump units, and each pumping unit includes a plurality of pumping elements. Each pumping element includes a pressure vessel with a first and a second chamber, a separating member between the first and second chambers, a measurement device adapted to measure the volume of at least one of the first and second chambers, a hydraulic inlet control valve and a hydraulic outlet control valve coupled to the first chamber, a mud suction valve and a mud discharge valve coupled to the second chamber. The first chamber is hydraulically coupled to receive and discharge a hydraulic fluid, and the second chamber is hydraulically coupled to receive and discharge a drilling fluid. The separating member is adapted to move within its the pressure vessel in response to a pressure differential between the first and second chambers. The pump system also includes a hydraulic control unit adapted to control the plurality of pump units.

Other aspects and advantages of the invention will be apparent from the following description and the appended claims.

DETAILED DESCRIPTION

Figure 1A:
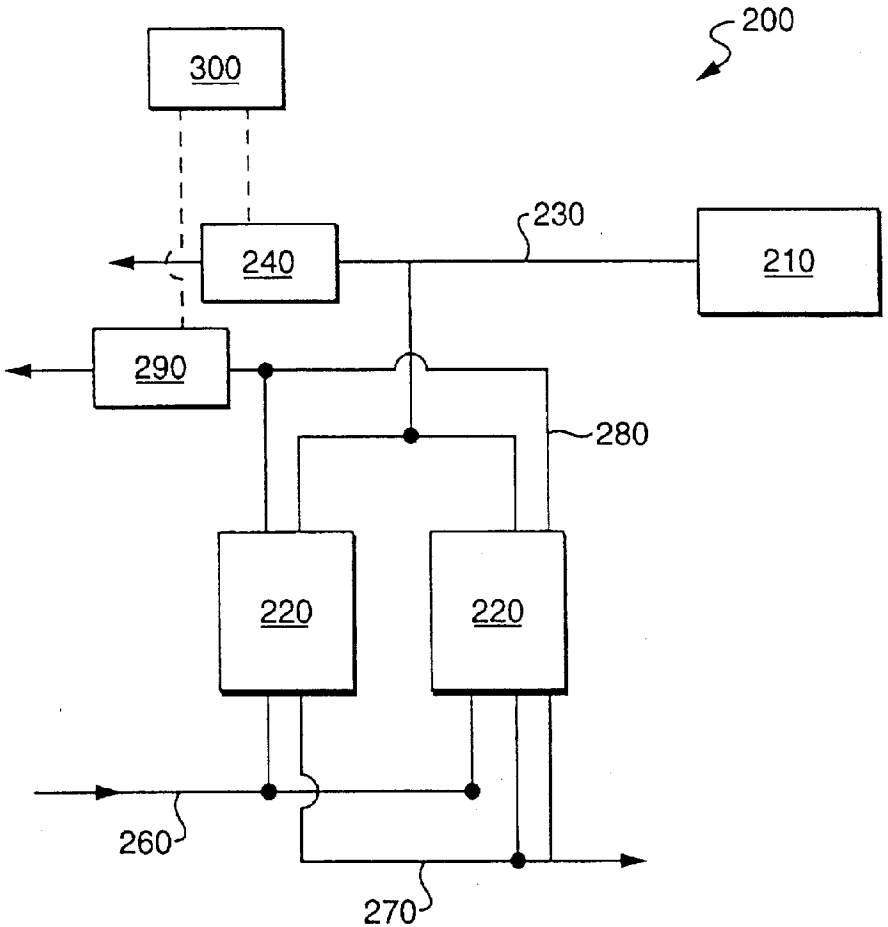
FIG. 1A shows a simplified schematic view of an embodiment of the invention.

FIG. 1A shows a simplified schematic view of an embodiment of the invention. A subsea pump 200 comprises a hydraulic power supply 210 and pumping elements 220. The hydraulic power supply 210 is hydraulically coupled to the pumping elements 220 by a hydraulic fluid supply line 230. The hydraulic fluid supply line 230 is also coupled to a valve 240. The valve 240 is operatively coupled to a valve controller 300 that is adapted to control a rate and time of application of hydraulic fluid to the pumping elements 220. A flow of drilling fluid is supplied to the pumping elements through an inlet line 260.

The flow of hydraulic fluid energizes the pumping elements 220, and the flow of hydraulic fluid into the pumping elements 220 generates a flow of drilling fluid out of the pumping elements 220 through a discharge line 270. Similarly, a flow of drilling fluid into the pumping elements 220 generates a flow of hydraulic fluid out of the pumping elements 220. Hydraulic fluid flows out of the pumping elements 220 through a hydraulic fluid discharge line 280. In some embodiments, a valve 290 is hydraulically coupled to the hydraulic fluid discharge line 280 and is operatively coupled to the valve controller 300. The valve controller 300 is adapted to operate the valve 290 so as to control a rate of discharge of the hydraulic fluid from the pumping elements 220.

By controlling, for example, the timing and rate of the application and discharge of hydraulic fluid to and from the pumping elements 220, respectively, operating characteristics of the subsea pump 200 such as a pump inlet pressure, a pump discharge pressure, and a total volume of drilling fluid in the pumping elements 220 may be selectively controlled. These and other aspects of the invention are described in detail below.

Figure 1B:
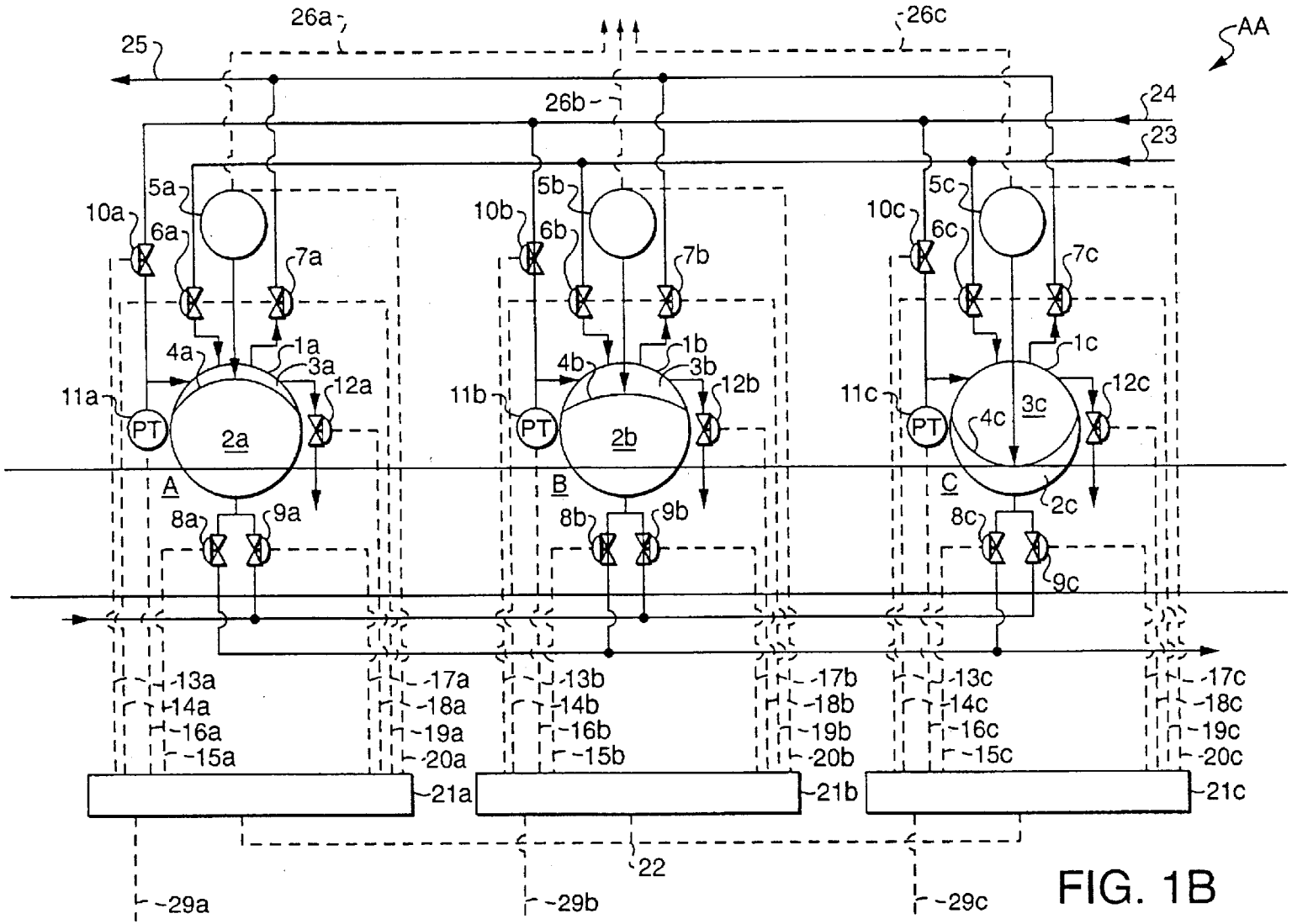
FIG. 1B shows a schematic diagram of an embodiment of a diaphragm pump module of the current invention.

FIG. 1B shows a detailed schematic diagram of an embodiment of a subsea diaphragm pump AA used in the invention. The subsea pump AA comprises three diaphragm pumping elements A, B, C connected by, for example, manifolds (not shown). The subsea pump AA shown in FIG. 1B essentially emulates a triplex positive displacement reciprocating pump. In some embodiments, a hydraulic fluid used to power the subsea pump AA and the pumping elements A, B, C comprises filtered seawater. However, other types of hydraulic fluid may be used to drive the subsea pump AA, and the use of filtered seawater is not intended to be limiting. Filtering of the seawater may be performed with equipment (not shown) located at the surface (e.g., on a drilling vessel (not shown)) or located proximate the seafloor.

Further, the embodiment shown in FIG. 1B includes three diaphragm pumping elements A, B, C. However, the number of pumping elements used with other embodiments of the invention may vary depending, for example, on factors such as a maximum flow rate required during operation, a desired redundancy of pumping elements, and packaging issues. Accordingly, embodiments of the invention may include, for example, from two diaphragm pumping elements or six diaphragm pumping elements. Moreover, linear piston-type pumps may also be used in some embodiments of the invention, and the examples below describing the operation of diaphragm pumps are not intended to be limiting.

Each of the pumping elements A, B, C comprises a vessel 1*a*, 1*b*, 1*c* with two chambers. The chambers comprise mud chambers 2*a*, 2*b*, 2*c* and hydraulic power chambers 3*a*, 3*b*, 3*c*, where the chambers are typically separated by separation elements, one example of which is substantially impermeable pump diaphragms 4*a*, 4*b*, 4*c*. In some embodiments, the diaphragms 4*a*, 4*b*, 4*c* comprise an elastomeric material. However, the diaphragms 4*a*, 4*b*, 4*c* may be formed from other materials, such as non-elastomeric materials or reinforced elastomeric materials, and the type of diaphragm material is not intended to be limiting.

In some embodiments of the invention, it is desirable to maintain a substantially constant inlet pressure (e.g., in the mud suction line 27). In other embodiments, it is desirable to maintain a substantially constant discharge pressure at a pump outlet (e.g., in the mud discharge line 28). If, for example, the inlet pressure is maintained at a substantially constant level, it is typical to let the discharge pressure "float" or vary during drilling operations. The opposite is also true when, for example, the discharge pressure is maintained at a substantially constant level. Various aspects of these embodiments of the invention are described in detail below. Note that operator preference, drilling conditions, etc. help determine which of the inlet pressure or the discharge pressure is maintained at a substantially constant level during drilling operations. Accordingly, the invention contemplates operating at all of the aforementioned conditions and incorporates the flexibility necessary to, for example, change from maintaining a substantially constant inlet pressure to maintain a substantially constant discharge pressure (and, if required, back again) during the process of drilling a well.

At the time interval shown in FIG. 1B, drilling mud has completely filled the mud chamber 2*a* of the first pumping element A, mud is filling the mud chamber 2*b* of the second pumping element B, and mud has been completely expelled from the mud chamber 2*c* of the third pumping element C. During operation of this embodiment of the invention, mud flows from a mud suction line 27 (which is operatively connected to all three pumping elements A, B, C) into the diaphragm pumping module AA. Mud in the mud suction line 27 is generally a mud return from a wellbore (not shown) being drilled. For example, mud may be stored and processed (e.g., degassed, desilted, weighted, etc.) at the surface before being pumped (e.g., via surface pumps) downhole (e.g., through a drillstring comprising drillpipe and a bottom hole assembly (BHA)) into the wellbore. Mud then flows uphole through an annulus between the drillstring and walls of the wellbore and into the mud suction line 27.

Mud from the mud suction line 27 then flows through actuated mud suction valves 9*a*, 9*b*, 9*c* and into the mud chambers 2*a*, 2*b*, 2*c* of the pumping module AA. After the mud chambers 2*a*, 2*b*, 2*c* have been filled, mud may then be pumped from the mud chambers 2*a*, 2*b*, 2*c* through actuated mud discharge valves 8*a*, 8*b*, 8*c* and into a mud discharge line 28. The mud discharge line 28 is typically connected to a mud return line (not shown) that is connected to mud handling and processing equipment (not shown) located at the water surface.

In some embodiments of the invention, the mud suction valves 9*a*, 9*b*, 9*c* and mud discharge valves 8*a*, 8*b*, 8*c* are power actuated valves of the type described in U.S. Pat. No. 6,102,673 issued to Mott et al. Power actuated valves are preferable, for example, when pumping mud returns from a drilled wellbore because the suction valves 9*a*, 9*b*, 9*c* and the discharge valves 8*a*, 8*b*, 8*c* may have to close and seal against large and irregularly shaped obstructions such as formation cuttings. Accordingly, power actuated valves are desirable because conventional spring biased check valves may be unable to close against such obstructions and thereby form an effective seal. However, conventional spring biased check valves may be used with embodiments of the invention. For example, spring biased check valves may be used with embodiments of the invention that use a diaphragm type mud pump of the type disclosed in U.S. Pat. No. 2,703,055 issued to Veth et al.

Hydraulic fluid is pumped into the hydraulic power chambers 3*a*, 3*b*, 3*c* from a flow regulated hydraulic fluid source 23 through respective hydraulic inlet control valves 6*a*, 6*b*, 6*c*. Hydraulic pressure in the hydraulic power chambers 3*a*, 3*b*, 3*c* is monitored by respective hydraulic chamber pressure transducers 11*a*, 11*b*, 11*c*. The inflow of hydraulic fluid moves the pump diaphragms 4*a*, 4*b*, 4*c* and displaces the diaphragms 4*a*, 4*b*, 4*c* so as to pump the mud out of the respective mud chambers 2*a*, 2*b*, 2*c*. For example (referring to FIG. 1B), when hydraulic fluid flows into the "upper" hydraulic power chambers 3*a*, 3*b*, 3*c*, mud is forced out of the "lower" mud chambers 2*a*, 2*b*, 2*c* and into the mud discharge line 28.

In contrast, when the mud chambers 2*a*, 2*b*, 2*c* are filling with mud, respective hydraulic outlet control valves 7*a*, 7*b*, 7*c* are opened and hydraulic fluid in the hydraulic power chambers 3*a*, 3*b*, 3*c* flows out through a discharge line 25. Note that in some embodiments that use seawater as the hydraulic fluid, the discharge line 25 may dump the seawater hydraulic fluid into the ocean proximate the subsea pump AA. The seawater embodiments are advantageous in that additional equipment (such as a hydraulic fluid recirculation system (not shown)) is not required to further transport the seawater hydraulic fluid. However, other embodiments may include a hydraulic fluid recirculation system (not shown) attached to the discharge line 25 so that the hydraulic fluid is reusable by returning the hydraulic fluid to the surface. For example, some embodiments of the invention may use oil as the hydraulic fluid. The oil-based hydraulic fluid may be recirculated rather than dumped into the sea. The oil-based hydraulic fluid is also advantageous because a pump pressure required to pump the oil-based hydraulic fluid at depth is typically less than a pump pressure required to pump the seawater hydraulic fluid at a similar depth.

Substantially instantaneous positions of the pump diaphragms 4*a*, 4*b*, 4*c* may be determined by position transducers 5*a*, 5*b*, 5*c* attached to the pump diaphragms 4*a*, 4*b*, 4*c* of each of the pumping elements A, B, C. In the embodiment shown in FIG. 1B, the position transducers 5*a*, 5*b*, 5*c* are magnetorestrictive linear displacement transducers (LDT) of the type disclosed in U.S. Pat. No. 6,102,673 issued to Mott et al. However, other types of position transducers may be used to measure the absolute position of the diaphragm, including but not limited to linear variable differential transformers (LVDT) and ultrasonic measurement devices. Accordingly, the type of position transducer is not intended to limit the scope of the invention.

The position of pump diaphragms 4*a*, 4*b*, 4*c* determined by the diaphragm position transducers 5*a*, 5*b*, 5*c* is used by sequencing devices 21*a*, 21*b*, 21*c* to determine when the pump diaphragms 4*a*,4*b*,4*c* have reached the "end" or limit (e.g., the top or bottom) of their stroke. In addition, the diaphragm position information may be conveyed to personnel and equipment aboard the floating drilling vessel (not shown) and is used in the operation of a constant volume flow control system (D in FIG. 4) to control the flow regulated hydraulic power source 23. Note that similar position transducers 5*a*, 5*b*, 5*c* may be used with embodiments of the invention that use linear piston-type pumps.

In order to ensure substantially constant discharge pressures from the subsea pump AA, it is important to compress drilling mud to a desired discharge pressure before it is discharged from the pump. Drilling mud returns at the seabed are likely to be more compressible than drilling mud pumped by mud pumps on the surface. For example, mud pumped through the mud pumps at the surface is typically cleaned of large cuttings (e.g., shale), sand, silt, and fluid returns from the well such as oil and/or brine, and is degassed before it is returned to the mud pumps for recirculation into the wellbore. On the seabed, it is possible that drilling mud returned directly from the wellbore to the subsea pump AA contains quantities of entrained gas or volatile liquid petroleum fractions, and even small quantities of gas and/or volatile liquids may substantially increase the compressibility of the drilling mud. Furthermore, at the high hydrostatic pressures encountered in deepwater drilling (e.g., at 10,000 feet below the surface, hydrostatic pressure is about 4500 psi), even completely gas free water based drilling mud may be compressible by 2–3% (with respect to a unit volume). Oil based drilling mud and certain drilling mud additives will typically be even more compressible than water based drilling mud.

Prior art subsea pumping relied on the belief that complete compression of the drilling mud could be achieved by properly controlling the hydraulic inlet valves. However, it has been determined that if a flow regulated hydraulic power source is used to finish the compression of the drilling mud prior to pumping the mud, it can result in negative pressure spikes in the mud chamber (e.g., mud chamber 2*a*) of the affected pump element (e.g., pump element A) and, as a result, can transmit the negative pressure spikes through the mud return line 28 (and, as a result, possibly damage other equipment).

Figure 2:
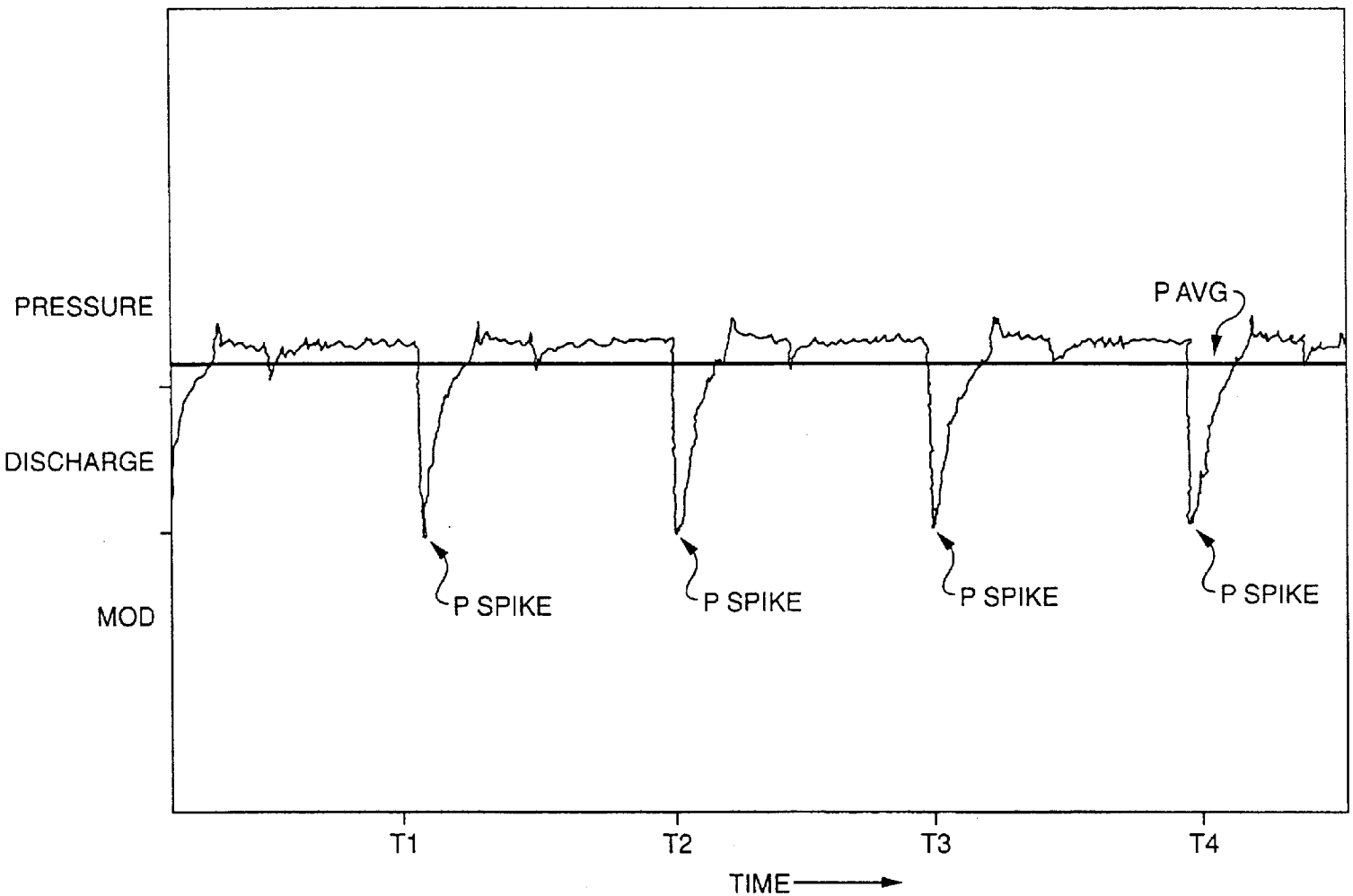
FIG. 2 shows a graph of pump discharge pressure versus time for an embodiment of a pump system of the current invention where the pump system operated without compression control valves.

FIG. 2 shows a graph of the discharge pressure versus time of a prior art subsea pump such as that shown in the Mott patent. The pump in FIG. 2 is in a duplex configuration (e.g., it comprises two diaphragm pumping elements), but the graph is typical of a pump with any number of diaphragm pumping elements. The graph shows that the pump typically operates at a relatively stable average pressure $P_{avg}$. However, note the extremely large negative pressure spikes $P_{spike}$ that are generated at times T1, T2, T3, T4 when the mud discharge valves open. At times T1–T4, if the mud in the mud chamber is compressible, the mud in the mud discharge line will flow into the mud chamber and cause the discharge pressure to drop suddenly (generating the pressure spikes $P_{spike}$) until the pressure in the mud chamber is equalized to the mud pressure in the mud discharge line.

In practice, it has been determined that negative pressure spikes are generally more severe at higher pump rates (e.g., at pump rates of approximately 4–5 strokes per minute or greater) because there is less time during the pump cycle for compressible mud to be compressed to the desired discharge pressure. In addition, high flow coefficient (Cv) piping is generally required for higher pump rates, and the high flow coefficient piping makes it difficult to precisely control the hydraulic inlet control valves at lower flow rates.

Referring again to FIG. 1B, the subsea pump AA of this embodiment of the invention comprises a hydraulic power source 24 (that is not flow regulated) and compression control valves 10*a*, 10*b*, 10*c* coupled to respective pump chambers 3*a*, 3*b*, 3*c*. The compression control valves 10*a*, 10*b*, 10*c* have flow coefficients (Cv) on the order of 0.1 to 0.01 times the Cv of the hydraulic inlet control valves 6*a*, 6*b*, 6*c* to help ensure smooth compression of the drilling mud in the mud chambers 2*a*, 2*b*, 2*c*. For example, hydraulic fluid from the hydraulic inlet control valve 6*a*, 6*b*, 6*c* flows into the respective hydraulic power chambers 3*a*, 3*b*, 3*c* and displaces the respective pump diaphragms 4*a*, 4*b*, 4*c*, thereby pressurizing the mud in the respective mud chambers 2*a*, 2*b*, 2*c*. Then, after the mud has been pressurized, but before the mud has been released from the respective mud chambers 3*a*, 3*b*, 3*c* through the mud discharge valve 8*a*, 8*b*, 8*c*, the compression control valve 10*a*, 10*b*, 10*c* opens briefly and allows pressurized hydraulic fluid from a non flow regulated hydraulic power source 24 to flow into the hydraulic chamber 3*a*, 3*b*, 3*c* and thereby pressurize the mud in the mud chamber 2*a*, 2*b*, 2*c* to substantially the same pressure as the desired mud discharge pressure.

Further, it has been determined that rapid opening of the hydraulic outlet control valves 7*a*, 7*b*, 7*c* (as required by high pump stroke rates), combined with the relatively high flow coefficients (Cv) of the hydraulic outlet control valves 7*a*, 7*b*, 7*c*, can cause severe hydraulic hammering of the system. Hydraulic hammering is produced by the "water hammer effect," where a sudden release of high pressure fluid into, for example, a flow conduit that is at a lower pressure generates a hydraulic "shock wave" in the system. The hydraulic hammering may damage the system by, for example, fatiguing tubular joints, valves, etc. after repeated occurrences.

Accordingly, embodiments of the invention include decompression control valves 12*a*, 12*b*, 12*c* that have flow coefficients (Cv) on the order of 0.01 to 0.1 times the Cv of the hydraulic outlet control valves 7*a*, 7*b*, 7*c*. Activation of the decompression control valves 12*a*, 12*b*, 12*c* produces a gradual reduction in pressure and helps ensure smooth discharge of the hydraulic fluid from the hydraulic power chambers 3*a*, 3*b*, 3*c* without hydraulic hammering. For example, after the mud has been completely pumped from the mud chamber 2*a*, 2*b*, 2*c* through the mud discharge valve 9*a*, 9*b*, 9*c* and hydraulic inlet control valve 6*a*, 6*b*, 6*c* is completely closed, the decompression control valve 12*a*, 12*b*, 12*c* is opened to gradually relieve pressure from the hydraulic power chamber 3*a*, 3*b*, 3*c*. In some embodiments that use filtered seawater as the hydraulic fluid, the decompression control valves 12*a*, 12*b*, 12*c* are vented to the sea. However, as previously explained, other arrangements are possible when, for example, the hydraulic fluid comprises a fluid other than seawater.

Both the compression 10*a*, 10*b*, 10*c* and decompression 12*a*, 12*b*, 12*c* control valves can be actuated for a selected period of time (for example, a fixed number of seconds or a fraction of the time required to complete a pump cycle), selectively actuated with reference to the pressure in the hydraulic power chamber 3*a*, 3*b*, 3*c* measured by pressure transducers 11*a*, 11*b*, 11*c*, or controlled by an algorithm that evaluates both time and pressure at any selected instant and actuates the valves accordingly.

In the embodiment shown in FIG. 1B, each diaphragm pumping element A, B, C is controlled by a sequencing device 21*a*, 21*b*, 21*c* which receives data signals from different parts of the diaphragm pumping elements A, B, C, and provides control signals to the various control valves as shown in the Figure. Data are transmitted to the sequencing devices 21*a*, 21*b*, 21*c* by, for example, a diaphragm position data link 20*a*, 20*b*, 20*c* and by a hydraulic chamber pressure link 16*a*, 16*b*, 16*c*.

The pump system operator can set various operational parameters via sequencing device data links 29*a*, 29*b*, 29*c*. The operational parameters are described in detail in the description of FIG. 3 below. Control signals are transmitted from the sequencing devices 21*a*, 21*b*, 21*c* to the various control valves by, for example, a decompression control valve data link 13*a*, 13*b*, 13*c*, a hydraulic inlet control valve data link 14*a*, 14*b*, 14*c*, a mud suction valve data link 15*a*, 15*b*, 15*c*, a mud discharge valve data link 17*a*, 17*b*, 17*c*, a decompression control valve data link 18*a*, 18*b*, 18*c*, and a hydraulic outlet control valve data link 19*a*, 19*b*, 19*c*. Moreover, the data and control signal links are understood to incorporate the necessary Input/Output (I/O) devices to accommodate the required signals to and from the sequencing devices 21*a*, 21*b*, 21*c*. Accordingly, the type of I/O devices used with the sequencing device system is not intended to be limiting.

Each sequencing device 21*a*, 21*b*, 21*c* may in turn be bussed together with the other sequencing devices through a sequencing device controller bus 22 so that the sequencing devices 21*a*, 21*b*, 21*c* may exchange data with each other. For economy, ease of programming, maintenance, and ease of trouble-shooting, it is preferable that the sequencing devices 21*a*, 21*b*, 21*c* be separate entities. In this manner, each sequencing device 21*a*, 21*b*, 21*c* controls the operation of one diaphragm pumping element A, B, C. However, it will be understood by those skilled in the art that one sequencing device could be used to control all three diaphragm pumping elements A, B, C, which would allow the elimination of the sequencing device controller bus 22 because the function of the bus would be handled internally by the independent sequencing devices 21*a*, 21*b*, 21*c*. Alternately, the sequencing devices 21*a*, 21*b*, 21*c* could be separate "virtual machines" that are physically operated and controlled by, for example, a single computer.

The absolute diaphragm position data from the diaphragm position LDTs 5*a*, 5*b*, 5*c* are transmitted by a diaphragm position data link 20*a*, 20*b*, 20*c* to the sequencing devices 21*a*, 21*b*, 21*c* and are compared to "full" and "empty" set points to determine if the mud chambers 2*a*, 2*b*, 2*c* have reached the point where they are full or empty of drilling mud. The full or empty status for each pumping element is used to trigger steps in the logic sequences performed by the sequencing devices 21*a*, 21*b*, 21*c*. The full and empty set points may be selected by the pump system operator or may be stored in a memory (not shown) of the sequencing devices 21*a*, 21*b*, 21*c*. Further, the set points may be modified by the pump system operator at any time during the operation of the pump AA.

For example, the pump arrangement AA shown in FIG. 1B comprises three diaphragm pumping elements A, B, C. In the embodiment, an "A Full" status (that indicates that mud chamber 2*a* is full of drilling mud) is an instruction for the sequencing device 21*a* to begin the process of compressing drilling mud in the mud chamber 2*a* (in diaphragm pumping element A), and for sequencing device 21*b* to begin the process of filling mud chamber 2*b* (in diaphragm pumping element B) with drilling mud. Similarly, a "C Empty" status (that indicates that mud chamber 2*c* is empty) is an instruction for the sequencing device 21*a* to begin pumping drilling mud from mud chamber 2*a* (in diaphragm pumping element A), and the "B Empty" status is an instruction for the sequencing device 21*c* to begin pumping drilling mud from mud chamber 2*c*. The sequencing of the embodiment shown in FIG. 1B is covered in more depth in the detailed description of FIG. 3 below. Diaphragm position data from each of the diaphragm position transducers 5*a*, 5*b*, 5*c* are sent from the pump elements A, B, C, through diaphragm position totalizer data links 26*a*, 26*b*, 26*c*, to a constant volume flow control system E, as shown in FIG. 4 and as described in detail below.

Figure 3:
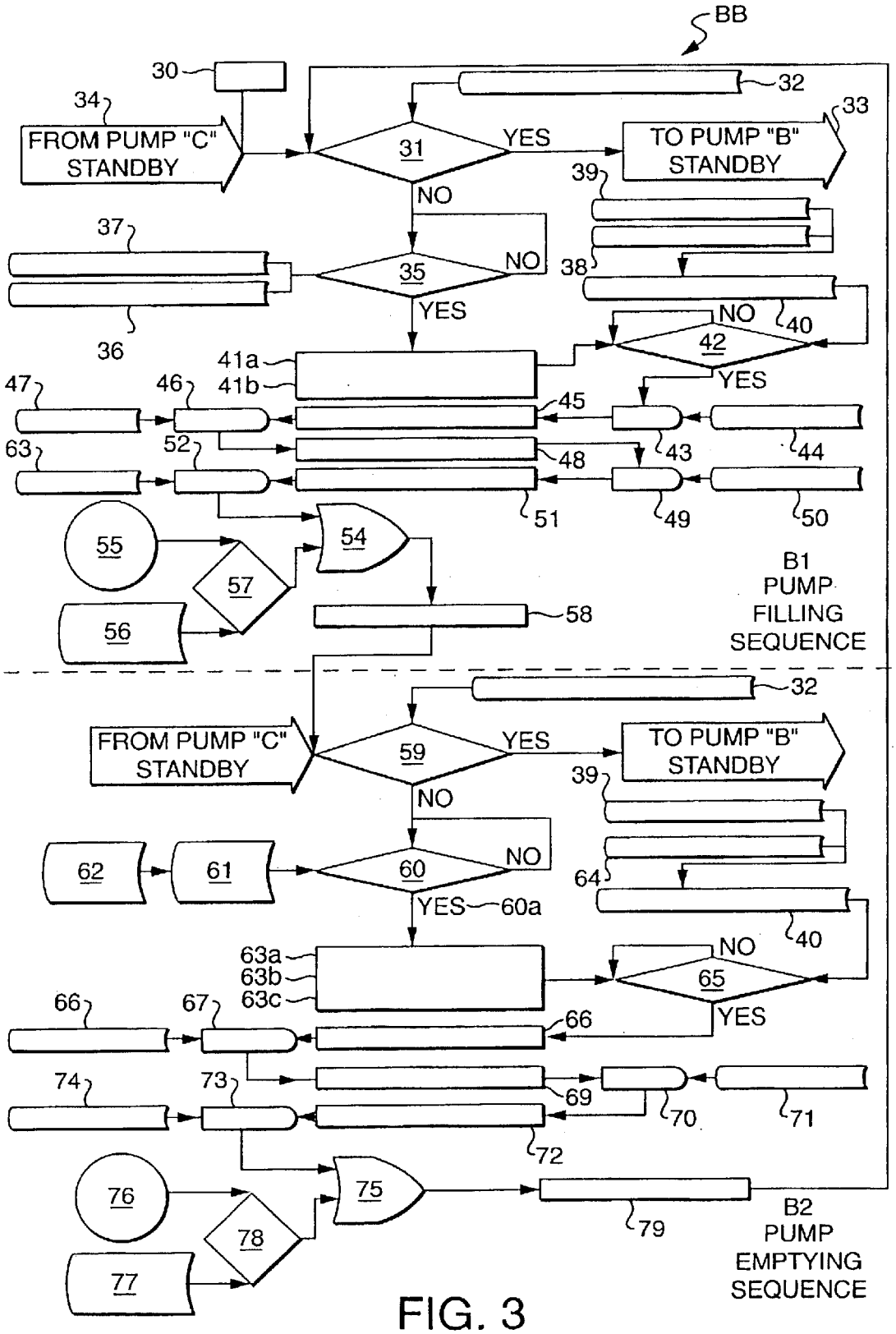
FIG. 3 shows a flow chart of an operation sequence of a pump in an embodiment of the invention.

FIG. 3 shows a simplified flow chart of a logic sequence BB that may be used by the sequencing device 21*a* for pump element A (of the three pumping element embodiment shown in FIG. 1B) in an embodiment of the invention. However, similar sequences could be used for systems that include more or fewer pump elements, and the description of the logic sequence BB shown in FIG. 3 is not intended to be limiting with respect to, for example, a number of pumps in an embodiment and/or a type of logic used to form the sequence. Further, it will be understood by those skilled in the art that, for example, an event driven logic sequence could be substituted for the boolean logic sequence BB shown in FIG. 3.

Logic Sequence

The embodiment of the logic sequence BB shown in FIG. 3 is divided into two parts separated by the dashed line: a "Pump Filling Sequence" B1 (shown above the dashed line), and a "Pump Emptying Sequence" B2 (shown below the dashed line). In this embodiment, the logic sequence BB starts with pump element A (e.g., mud chamber 2*a*) empty of drilling mud and with diaphragm pumping element C (e.g., mud chamber 2*c*) full of drilling mud. However, the "start-up" condition is not intended to be limited by any single set of empty/full conditions for a single pumping chamber. For example, a similar "start-up" condition could include a check of an empty/full status of pump elements B and C.

After a START signal 30 (which may be initiated, for example, by a signal from the sequencing device 21*a* or by the pump system operator), the logic sequence BB queries a pump A standby status register 32 at a pump A standby decision step 31. Note that "standby status" is typically designated by the pump system operator. However, standby status could be designated by, for example, pump monitoring software or by downhole sensors. Accordingly, the method of designating standby status is not intended to be limiting.

For example, in some embodiments of the invention, if any of the pump elements A, B, C require service while the subsea pump AA is running, the standby status of the pump element A, B, C requiring service can be set to a "YES" value by a signal from the pump system operator. When a pump element A, B, C of, for example, a triplex pump arrangement, is set to "STANDBY," the standby status will have the effect of temporarily converting the operation of the triplex subsea pump into a duplex pump (e.g., the standby setting will effectively remove the standby pump element from the pumping sequence).

If the pump element A has a "NO" value as its standby status, the logic sequence BB then queries a pump C fill status register 36 at a pump C fill status decision step 35 to determine whether pump element C (e.g., mud chamber 2*c*) is full of drilling mud. Note that a "FULL" set point 37 of the pump C fill status register 36 may be defined by personnel on the floating drilling vessel (not shown) or may be preprogrammed into the logic sequence BB.

If pump element C is not full (e.g., if the pump C fill status register 36 has a "NO" value), the logic sequence BB loops until it receives indication that pump element C (e.g., mud chamber 2*c*) is full of drilling mud (e.g., until the Pump C fill status register 36 is set to "YES"). When pump element C is full of drilling mud, the sequencing device 21*a* sends signals 41*a*, 41*b* to open the mud suction valve 8*a* and the hydraulic outlet control valve 7*a*, respectively. Thereafter, mud begins flowing from the mud suction line 27, through the mud suction valve 9*a*, and into the mud chamber 2*a*. As the mud chamber 2*a* is filling, hydraulic fluid is displaced from the hydraulic power chamber 3*a* and flows out of the hydraulic power chamber 3*a* through the hydraulic outlet control valve 7*a* into the discharge line 25. The aforementioned process of filling mud chamber 2*a* and simultaneously emptying hydraulic power chamber 3*a* continues until a signal 39 from the diaphragm position transducer 5*a* matches a pump A "FULL" status set point 38. At this point, a pump A fill status 40 is set to a "FULL" value.

When the pump element A mud chamber 2*a* is full, a signal from a pump A full decision step 42 starts a mud suction close timer 43, which delays the logic sequence BB for a delay time 44. After the delay time 44 has expired, a "close" signal 45 is transmitted to the mud suction control valve 9*a*. Similarly, there is then a delay of delay time 47 initiated by a hydraulic outlet close timer 46 before a "close" signal 48 is sent to the hydraulic outlet control valve 7*a*. Further, a delay of delay time 50 is initiated by a compression valve open timer 49 before an "open" signal 51 is sent to the compression valve 10*a*. The delays are used to ensure that the drilling mud and hydraulic flow paths to the next chamber have been established prior to closing the currently filling or emptying chamber. Accordingly, the delays help prevent system damage that may occur if there is no flow path open on either the mud or hydraulic side of the system at a selected time.

Note that operation of the compression valve 10*a* is shown within the pump filling sequence B1 because the mud discharge valve 8*a* is still closed. Compression of the mud in the mud chamber 2*a* should be understood as a step to "condition" the mud to be pumped, rather than as a part of the pumping process (e.g., a part of the pump emptying sequence B2).

The compression valve 10*a* generally remains open until a pressure 55 in the hydraulic power chamber 3*a*, as measured by a pressure transducer 11*a*, reaches a predetermined set point 56 (as determined by a comparator 57), or until a Pump C status 60*a* is "YES." A condition satisfying an "OR" element 54 initiates transmission of a signal 58 to close the compression valve 10*a* when the pressure 55 is achieved or the Pump C "YES" status 60*a* has been achieved.

After the compression valve 10*a* is closed, the logic sequence BB again polls the pump A standby status register 30 for pump element A at a pump A standby decision step 59. Note that this means that both the pump emptying B2 and pump filling B1 sequences start with a determination of whether the particular diaphragm pump element A, B, or C is in active or standby status. Consequently, if a pump element is placed on standby status during operation, the pump element (that is placed on standby during operation) will finish the current half cycle (e.g., filling B1 or emptying B2), and thereafter that particular pump element will be bypassed in the pumping order of the subsea pump AA.

If pump element A is not on standby status, the sequencing device 21*a* then polls a pump C fill status register 61 to determine if the mud chamber 2*c* of pump element C is empty of drilling mud. The "empty" condition is defined by an empty set point 62.

Note that the only external references in the logic sequence BB available to the sequencing devices 21*a*, 21*b*, 21*c* for each pump element A, B, C is the "full" and "empty" status of its "partner" pump element in the sequence, which is polled twice during each pump stroke (e.g., once before the pump filling sequence B1 and once before the pump emptying sequence B2). For example (and to further describe the pumping element "partners"), the only external reference for the sequencing device 21*a* for pump element A is the pump status register for pump element C. Similarly, the sequencing device 21*b* for pump element B refers to the fill status register for pump element A, and the sequencing device 21*c* for pump element C refers to the fill status register for pump element B. Note that while prior art diaphragm pump controls attempt to keep multiple diaphragm pumping elements strictly in a selected phase relationship, the sequencing devices 21*a*, 21*b*, 21*c* of the current embodiments only keep the pump elements A, B, C in a selected operating sequence.

Referring again to FIG. 3, if pump element C is empty (of drilling mud), the sequencing device 21*a* sends a signal 63*a* to ensure that the compression valve 10*a* is closed, a signal 63*b* to open the hydraulic inlet control valve 6*a*, and a signal 63*c* to open the mud discharge valve 8*a*. At this point, hydraulic fluid flows from the flow regulated hydraulic power source 23, through the hydraulic inlet valve 6*a*, and into the hydraulic power chamber 3*a*, thereby displacing the pump diaphragm 4*a* and forcing drilling mud from the mud chamber 2*a* out through the mud discharge valve 8*a*, into the mud discharge line 28 and, subsequently, back to the floating drilling vessel (not shown) on the surface. The process of filling the hydraulic power chamber 3*a* and emptying the mud chamber 2*a* continues until the signal 39 from the diaphragm position transducer 5*a* matches a pump A "EMPTY" fill status set point 64, and the pump A fill status register 40 is then set to "EMPTY."

When the pump A fill status register 40 is set to "EMPTY," a pump A empty decision step 65 then sends a signal 66 to close the mud discharge valve 8*a*. There is a delay of delay time 68 (controlled by the hydraulic inlet close timer 67) before a signal 69 is sent to close the hydraulic inlet control valve 6*a*. There is then a further delay of delay time 71 (controlled by a decompression valve open timer 70) before a signal 72 is sent to open the decompression valve 12*a*. When the decompression valve 12*a* opens, hydraulic fluid is expelled (e.g., into the sea or into a hydraulic fluid recirculation chamber (not shown)) as pressure is gradually released from the hydraulic power chamber 3*a*.

The decompression valve 12*a* remains open until either a selected compression time 74 has passed, as determined by decompression open timer 73, or a pressure 76 in the hydraulic power chamber 3*a*, as measured by a pressure transducer 11*a*, reaches a predetermined set point 77 as determined by a comparator 78. A signal 79 to close the decompression valve 12*a* is initiated by an "OR" function 75 that is connected to the decompression open timer 73 and the comparator 78.

At this point, the second half (e.g., the pump emptying sequence B2) of the logic sequence BB has been completed. Pump element A is now ready to begin the logic sequence BB again after being activated by the sequencing device 21*a*.

Hydraulic Control System

Figure 4A:
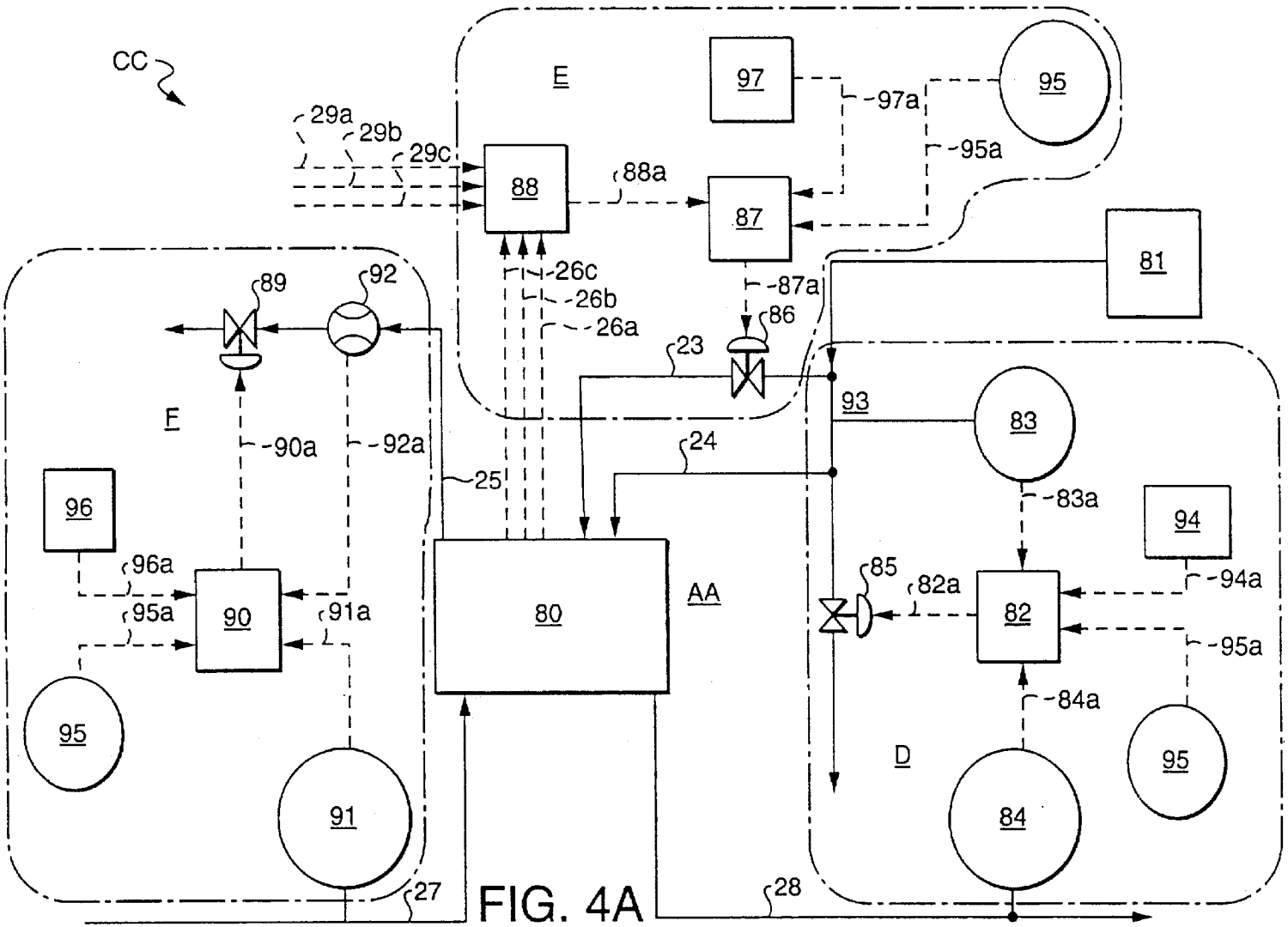
FIG. 4A shows an embodiment of a hydraulic control system.

FIG. 4A shows an embodiment of a hydraulic control system CC that can be used to regulate the flow of hydraulic fluid in and out of the pump elements (A, B, C in FIG. 1B) in embodiments of the invention. Note that the flow rate of drilling mud is not directly measured by the hydraulic control system CC because drilling mud returns from a wellbore may be extremely erosive, and flow measurement of the erosive drilling mud can be unreliable. Alternatively, the flow rate of the drilling mud can be accurately derived from either diaphragm displacement data or from flow rate measurements of the relatively "cleaner" hydraulic fluid. One advantageous characteristic of the subsea pump AA is that the pump elements have a substantially 1:1 pumping ratio (e.g., where there is no hydraulic "slip") so that the flow rate of hydraulic power fluid into the subsea pump AA is proportional to the flow rate of drilling mud out of the subsea pump AA.

The subsea pump AA shown in FIG. 4A is a simplified representation of the pump shown in FIG. 1B. The subsea pump AA has inputs comprising the flow regulated hydraulic power source 23, the non flow regulated hydraulic power source 24, and the mud suction line 27. The subsea pump AA also has outlets that comprise the discharge line 25, the diaphragm position totalizer data links 26*a*, 26*b*, 26*c*, and the mud discharge line 28.

The subsea pump AA comprises a self contained, self controlled pumping unit which pumps drilling mud at a selected flow rate and pressure increase from the mud suction line 27 to the mud discharge line 28, depending only on the hydraulic power supplied by the flow regulated hydraulic power source 23, the non flow regulated power source 24, and flow restriction, or throttling, applied to the discharge line 25.

In the embodiment shown in FIG. 4A, hydraulic power is supplied by hydraulic fluid from the hydraulic power source 81, which, in some embodiments, comprises a pump preferentially located on a floating drilling vessel (not shown). For example, positioning the hydraulic power source 81 on the floating drilling vessel (not shown) would allow using conventional drilling mud pumps as the hydraulic power source 81, wherein the hydraulic fluid is conveyed from the surface to the subsea pump AA via a high pressure fluid conduit (not shown). Alternatively, the hydraulic power source 81 may comprise a submersible hydraulic pump (not shown) located proximate the subsea pump AA on the seabed. For example, in some embodiments the hydraulic power source 81 may comprise a submersible electric pump (not shown) that receives electric power from the floating drilling vessel (not shown) on the surface.

The pressure of the inflow of hydraulic fluid at a hydraulic manifold 93 is controlled by a hydraulic pressure control system D. The hydraulic pressure control system D is designed to maintain the hydraulic fluid at a higher pressure than the mud being discharged from the subsea pump AA to ensure that there are no negative pressure spikes in the mud discharge line 28.

For example, the pump system operator can select a desired pressure differential between the mud discharge line 28 and hydraulic manifold 93 by controlling a pressure differential set point 94. Typically, the selected pressure differential will be between 50 and 150 psi, and a pressure differential in this range is generally high enough to prevent negative pressure spikes in the system when the mud discharge valves (8*a*, 8*b*, 8*c* in FIG. 1B) are opened but low enough to avoid hydraulic hammering of the system when the hydraulic outlet control valves (7*a*, 7*b*, 7*c* in FIG. 1B) are opened.

Pressure in the hydraulic manifold 93 is regulated by a dump valve 85, and the dump valve 85 is modulated by a dump valve controller 82 via a dump valve controller data link 82*a*. The dump valve controller 82 operates in response to a differential pressure calculated by subtracting a value equal to a pressure in the mud discharge line 28 (typically measured by a mud discharge pressure transducer 84, preferentially located on or proximate the subsea pump AA) from a value equal to a pressure in the hydraulic manifold 93 (typically measured by a pressure transducer 83 located on the hydraulic manifold 93), and then modulates the dump valve 85 to achieve the preselected differential pressure. However, the differential pressure described above may also be measured by subtracting pressures measured at alternative locations in the pumping system, and the location at which the differential pressure is calculated is not intended to be limiting.

Pressure modulation via the dump valve 85 helps ensure that the pressure in the hydraulic control system CC is greater than the pressure of the discharged mud so that when the mud discharge valves 8*a*, 8*b*, 8*c* open during the pumping cycle, the mud inside the mud chambers 2*a*, 2*b*, 2*c* is generally at a higher pressure than the mud in the mud discharge line 28. Moreover, in some embodiments of the invention, the dump valve 85 may be modulated to maintain a substantially constant mud discharge pressure. In these embodiments, the dump valve controller 82 monitors the discharge pressure measured by the pressure transducer 84 and adjusts the dump valve 85 to maintain the substantially constant discharge pressure.

Hydrostatic pressure (e.g., ambient pressure at depth) is measured by a hydrostatic pressure transducer 95 and is communicated to the dump valve controller 82 via a hydrostatic pressure data link 95*a*. If desired, the measured hydrostatic pressure can be used by the dump valve controller 82 as a reference pressure. For example, pressure in the hydraulic manifold 93 could be regulated at 150 psi above pressure in the mud discharge line 28, but in no case less than the reference hydrostatic pressure. Also note that hydraulic fluid in the hydraulic manifold 93 flows directly into the subsea pump AA as the non flow regulated hydraulic power source 24 and through a total volume control valve 86 as the flow regulated hydraulic power source 23.

The hydraulic pressure control system D is advantageous because, in prior art designs, a pressure of the hydraulic fluid is not controlled relative to a mud discharge pressure measured proximate a subsea positive displacement pump, which can result in mud discharge pressure "spikes" if the hydraulic pressure drops so that the mud in the discharge piping is at a higher pressure than the mud in the mud chambers (2*a*, 2*b*, 2*c* in FIG. 1B) when a mud discharge valve (8*a*, 8*b*, 8*c* in FIG. 1B) opens during the pumping cycle. As described above with reference to FIG. 1B, if the pressure of the drilling mud in the discharge pipe 28 is greater than the pressure of the drilling mud in the mud chambers (2*a*, 2*b*, 2*c* in FIG. 1B), a back flow characterized by a negative pressure spike may result when drilling mud flows from the discharge pipe 28 into the mud chambers (2*a*, 2*b*, 2*c* in FIG. 1B) when the mud discharge valves (8*a*, 8*b*, 8*c* in FIG. 1B) are opened.

Constant Volume Flow Control System

One of the fundamental control strategies used to control fluid flow both into and out of the subsea pump AA is to maintain a constant volume of drilling mud in the hydraulic power chambers 3*a*, 3*b*, 3*c* at any selected time by regulating the flow of hydraulic fluid into the subsea pump AA. A net result is maintenance of a selected total volume of drilling mud in the mud chambers 2*a*, 2*b*, 2*c* at any selected time.

The flow rate of hydraulic fluid in the flow regulated hydraulic power source 23 is regulated by the constant volume flow control system E, the goal of which is to maintain the total volume of drilling mud in the subsea pump AA (e.g., in the mud chambers (2*a*, 2*b*, 2*c* in FIG. 1B)). The embodiment shown in FIG. 4A uses a measurement of a total instantaneous volume of the mud chambers (2*a*, 2*b*, 2*c* in FIG. 1B) to keep the pump elements (A, B, C in FIG. 1B) in phase. A mathematical proof of the relationship between total mud volume and pump phase is discussed below in the section entitled Phase and Total Volume.

A pump volume totalizer 88 determines an instantaneous total volume of the mud chambers (2*a*, 2*b*, 2*c* in FIG. 1B) by summing the instantaneous total mud volume of the mud chambers (2*a*, 2*b*, 2*c* in FIG. 1B) based on positions of the individual pump diaphragms (4*a*, 4*b*, 4*c* in FIG. 1B) and an algorithm which relates diaphragm position to mud volume of the related mud chamber (2*a*, 2*b*, 2*c* in FIG. 1B). For an example of how to determine the instantaneous total mud volume of the mud chambers (2*a*, 2*b*, 2*c* in FIG. 1B), refer to the section below entitled Measuring Mud Chamber Volume.

Total volume control valve 86 receives control signals from total volume valve controller 87 via a valve control signal 87*a*. The total volume valve controller 87 compares a total volume set point 97*a* with an instantaneous volume of the mud chambers (2*a*, 2*b*, 2*c* in FIG. 1B) supplied to the total volume valve controller 87 by the pump volume totalizer 88 via the total volume data link 88*a*. If, for example, the instantaneous volume of mud in the mud chambers (2*a*, 2*b*, 2*c* in FIG. 1B) is greater than the total volume set point 97*a* (which generally indicates that the pump rate is too low), the total volume control valve 86 will be opened slightly, thereby increasing the pump rate of the mud chambers (2*a*, 2*b*, 2*c* in FIG. 1B) and tending to bring the pump elements (A, B, C in FIG. 1B) back into a desired phase relationship.

Alternative Embodiment

Figure 4B:
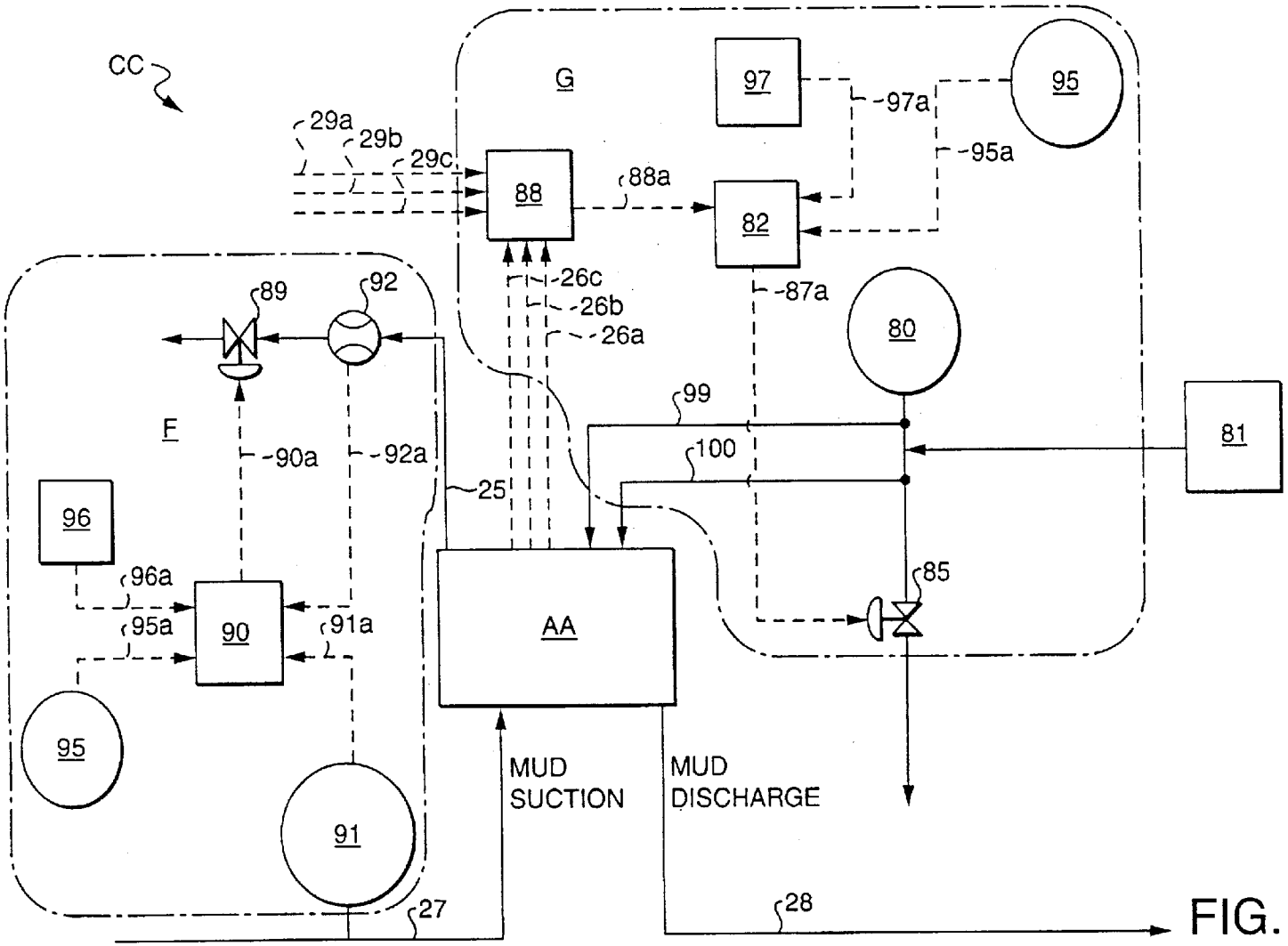
FIG. 4B shows another embodiment of a hydraulic control system.

FIG. 4B shows another embodiment of the hydraulic control system CC. The embodiment shown in FIG. 4B is similar to the embodiment shown in FIG. 4A except, for example, for the absence of a designated hydraulic pressure control system (e.g., hydraulic pressure control system D in FIG. 4A). The embodiment in FIG. 4B essentially combines the hydraulic pressure control system (D in FIG. 4A) and the constant volume control system (E in FIG. 4A) into a unitary constant volume flow control system G.

As in the previous embodiment, the subsea pump AA is a simplified representation of the schematic diagram shown in FIG. 1B. The subsea pump AA has the hydraulic power source 81 as an input. The subsea pump AA also has outlets that comprise the discharge line 25, the diaphragm position totalizer data links 26*a*, 26*b*, 26*c*, and the mud discharge line 28. Note that the total volume control valve (86 in FIG. 4A) has been eliminated and that the dump valve controller 82 has replaced the flow rate valve controller (87 in FIG. 4A). The dump valve 85 now performs the function of regulating total volume in the system CC subject to control inputs from the dump valve controller 82. An accumulator 98 may be used with the system to condition a flow of hydraulic fluid. For example, the accumulator 98 may be adapted to maintain a sufficiently high pressure in hydraulic flow lines 99, 100 (e.g., to prevent negative pressure spikes in the system).

The flow rate of hydraulic fluid in the flow regulated hydraulic power source 23 is regulated by the constant volume flow control system E, the goal of which is to maintain a substantially constant total volume of drilling mud in the subsea pump AA (e.g., in the mud chambers (2*a*, 2*b*, 2*c* in FIG. 1B)) at any selected time. The embodiment shown in FIG. 4B uses a measurement of a total instantaneous volume of the mud chambers (2*a*,2*b*,2*c* in FIG. 1B) to keep the pump elements (A, B, C in FIG. 1B) in sequence. As in the previous embodiment, refer to the section entitled Phase and Total Volume below for a mathematical proof of the relationship between total mud volume and phase.

The pump volume totalizer 88 determines an instantaneous total volume of the mud chambers 2*a*,2*b*,2*c* by summing the instantaneous total mud volume of the mud chambers (2*a*, 2*b*, 2*c* in FIG. 1B) based on positions of the individual pump diaphragms (4*a*, 4*b*, 4*c* in FIG. 1B) and an algorithm which relates diaphragm position to mud volume of the related mud chamber (2*a*, 2*b*, 2*c* in FIG. 1B). For an example of how to determine the instantaneous total mud volume of the mud chambers (2*a*, 2*b*, 2*c* in FIG. 1B), refer to the section below entitled Measuring Mud Chamber Volume.

The dump valve 85 receives control signals from the dump valve controller 82 via the valve control signal 87*a*. The dump valve controller 82 compares the total volume set point 97*a* with an instantaneous volume of the mud chambers (2*a*, 2*b*, 2*c* in FIG. 1B) supplied to the dump valve controller 87 by the pump volume totalizer 88 via the total volume data link 88*a*. If, for example, the instantaneous volume of mud in the mud chambers (2*a*, 2*b*, 2*c* in FIG. 1B) is greater than the total volume set point 97*a* (which generally indicates that the pump rate is too low), the dump valve 85 will be opened slightly, thereby increasing the pump rate of the mud chambers (2*a*, 2*b*, 2*c* in FIG. 1B) and tending to bring the pump elements (A, B, C in FIG. 1B) back into a desired phase relationship.

Hydrostatic pressure is measured by the hydrostatic pressure transducer 95 and is communicated to the dump valve controller 82 via a hydrostatic pressure data link 95*a*. If desired, the measured hydrostatic pressure can be used by the dump valve controller 82 as a reference pressure. For example, pressure in the hydraulic manifold 93 could be regulated at 150 psi above pressure in the mud discharge line 28, but in no case less than the reference hydrostatic pressure.

It has been determined that, in some embodiments of the invention, the accumulator 98 and the inherent compressibility of the hydraulic fluid enables adequate conditioning (e.g., compression, filtering, etc.) to pressurize the hydraulic fluid to a sufficient level relative to the mud being discharged from the subsea pump AA to ensure that there are no negative pressure spikes in the mud discharge line 28. Note that although the accumulator 98 is shown to be a separate item in FIG. 4B, the accumulator 98 may be included in, for example, the hydraulic flow lines 99, 100. Accordingly, the embodiment shown in FIG. 4B is not intended to limit the location or type of accumulator 98 that may be used with the hydraulic control system CC.

Fill-Rate Flow Control System

In some embodiments of a pump according to the invention, the rate at which the hydraulic fluid is discharged from the pump elements (A, B, C in FIG. 1B) controls a pump rate of the subsea pump AA. Subsea pumps AA used in the various embodiments of the invention have a 1:1 ratio between a volume of hydraulic fluid and a volume of drilling mud that flow through the subsea pump AA in a selected cycle. Further, the individual pump elements (A, B, C in FIG. 1B) are maintained in proper sequence by the sequencing devices (21*a*, 21*b*, 21*c* in FIG. 1B). Accordingly, because the total volume of the mud chambers (2*a*, 2*b*, 2*c* in FIG. 1B) remains substantially constant, the flow rate of the drilling mud can be precisely controlled (e.g., with very little control error) by controlling the discharge rate of the hydraulic fluid (e.g., the flow rate of the hydraulic fluid discharge can be controlled to equal the desired flow rate of the drilling mud).

The hydraulic fluid discharged from the subsea pump AA passes through the discharge line 25. The discharge flow rate is measured by a discharge flow meter 92. The flow rate in the discharge line 25 is regulated by a discharge control valve 89. The discharge control valve 89 is, in turn, controlled by a discharge controller 90, and the discharge controller 90 uses data received through an inlet pressure data link 91*a* (from an inlet pressure transducer 91 that measures the pressure of the drilling mud in the mud suction line 27) or through a flow data link 92*a* (from the discharge flow meter 92).

There are three particular drilling mud flow rate modes that are typically required during subsea mudlift drilling operations: a constant annulus pressure mode, a constant flow rate mode, and a "make connection" mode. The constant annular pressure mode is designed to maintain a substantially constant pressure at the subsea pump inlet regardless of flow rate. Assuming that the hydrostatic and friction pressures in the wellbore annulus are generally constant, a substantially constant inlet pressure results in a substantially constant bottom hole pressure (BHP), which is required to maintain well control. In the constant pressure mode, the control system CC adjusts the pump rate of the subsea pump AA to maintain pump inlet pressure at a substantially constant level. For example, if the wellbore annulus pressure starts to rise above a preselected pressure set point, the subsea pump AA must operate at a higher stroke rate (e.g., pump at a higher flow rate) to maintain the inlet pressure at a preselected level. Moreover, if the inlet pressure drops below another preselected pressure set point, the stroke rate of the subsea pump AA must be decreased to maintain the inlet pressure at the preselected level.

In contrast, the constant flow rate mode seeks to maintain a constant volumetric flow rate from the wellbore annulus regardless of wellbore pressure. The constant flow rate mode is analogous to the "pulsation free" pumping method disclosed in U.S. Pat. No. 6,102,673 issued to Mott et al. The ability to pump at a substantially constant flow rate is required for selected well control activities used in dual gradient drilling systems.

The "make connection" mode is used when, for example, surface pumps must be stopped to add more drillpipe to a drillstring (e.g., when drilling personnel on the floating drilling vessel "make a connection"). The make connection mode is described in detail below.

When the subsea pump AA is operating (in a substantially steady state mode during, for example, normal drilling operations), the bottom hole pressure (BHP, or annular pressure at a drill bit) may be defined as:

$$BHP=P_{HYD}+P_{AFP}+P_{INLET} \quad (1)$$

where $P_{HYD}$ is a hydrostatic pressure of a mud column from the drill bit to the pump inlet, $P_{AFP}$ is an annular friction pressure generated by resistance to drilling mud flow in the annulus between the drillpipe and the walls of the wellbore (not shown), and $P_{INLET}$ is a pressure in the wellbore annulus measured at the suction line 27 to the subsea pump AA. Note that the relationship between $P_{AFP}$ and flow rate will usually be linear at the flow rates expected in normal drilling operations (e.g., return flow of drilling mud in the wellbore annulus will generally be laminar). Further, during normal drilling operations, the largest contribution to BHP will be the hydrostatic pressure of the mud column in the wellbore annulus above the drill bit.

In order to prevent the well from flowing (e.g., to prevent formation fluids from entering the wellbore and generating a "kick"), the BHP must generally be maintained at a known, constant level during the entire drilling process, including during the "make connection" process. If the surface pumps on the floating drilling vessel are stopped, the contribution of $P_{AFP}$ is lost. The pressure drop attributable to the loss of $P_{AFP}$ must be compensated for in order to maintain a substantially constant BHP so as to maintain proper well control. Because the hydrostatic pressure of mud in the drillpipe ($P_{HYD}$) is substantially constant, the inlet pressure ($P_{INLET}$) must be increased to compensate for the loss $P_{AFP}$.

Figure 6:
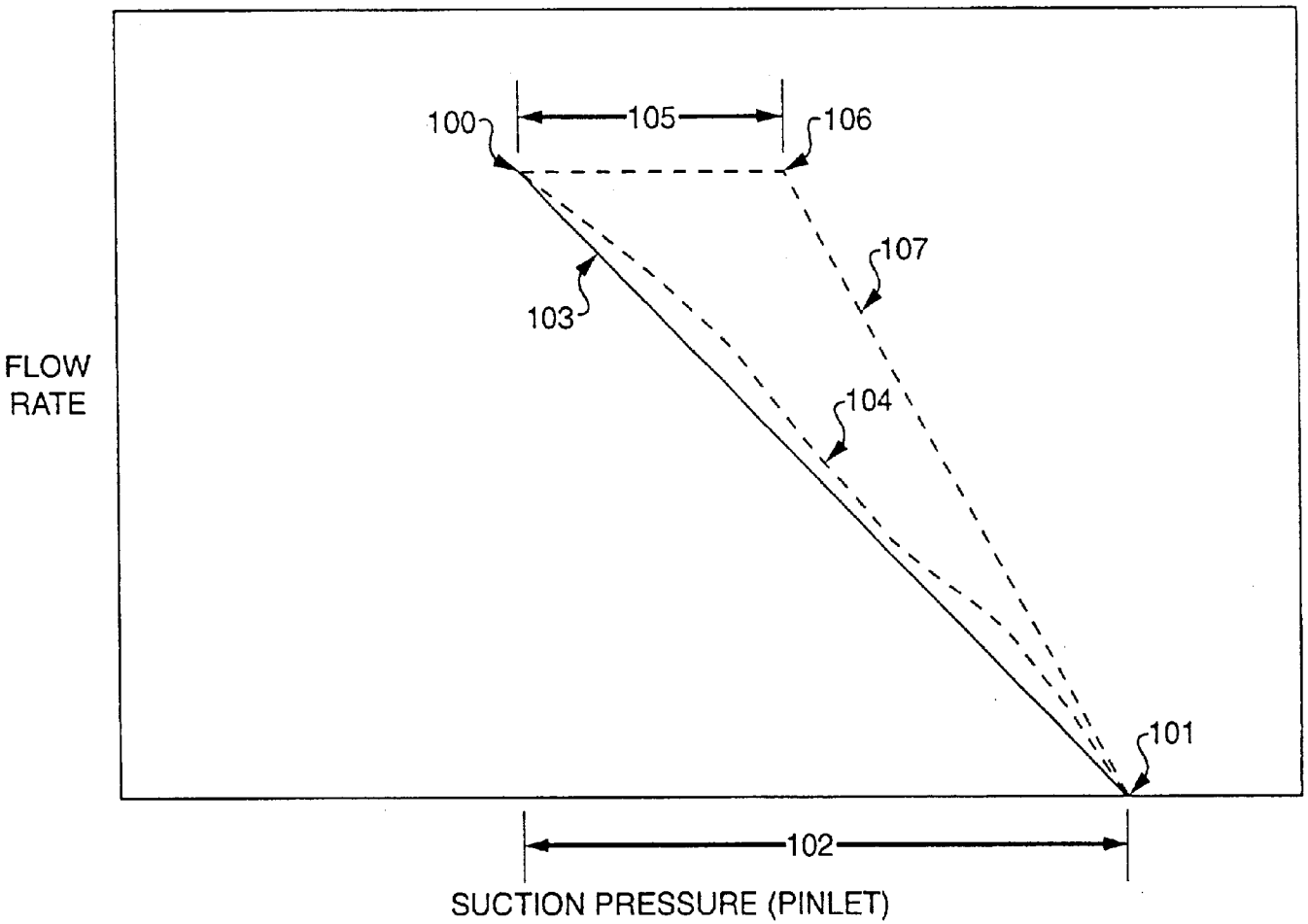
FIG. 6 shows a graph of flow rate versus pressure in a mud suction line in an embodiment of the invention when pumps are stopped to make a connection.

FIG. 6 shows a graph of flow rate versus inlet (suction) pressure in the mud suction line (27 in FIG. 4). During normal drilling operations, suction pressure ($P_{INLET}$) in the mud suction line (27 in FIG. 4) is maintained at a suction pressure set point 100. $P_{INLET}$ 101 required to maintain the BHP at zero flow rate is greater than the suction pressure set point 100 by an amount equal to the annular friction pressure ($P_{AFP}$) 102. $P_{AFP}$ is linear with respect to flow rate, so $P_{INLET}$ required to maintain a substantially constant BHP at any flow rate may be graphically represented by a line 103 drawn between the suction pressure set point 100 and $P_{INLET}$ required to maintain BHP at zero flow rate 101. Accordingly, whenever surface pumps (not shown) are turned off to "make a connection," $P_{INLET}$ must be maintained at a pressure that graphically falls to the right of the line 103 in order to maintain a substantially constant BHP.

In practice, because there are several "throttles" or controls in a fluid path between the surface pumps (not shown) and the wellbore annulus (not shown) (including, for example, nozzles (not shown) in the drill bit (not shown)), if the surface pumps (not shown) are stopped abruptly, $P_{INLET}$ and flow rate will drop to the left of the line 103. If this occurs, then the BHP at zero flow rate will be at a level below $P_{INLET}$ required to maintain a substantially constant BHP (e.g., lower than the minimum $P_{INLET}$ 101 required to maintain BHP at zero flow rate). This situation may be avoided by implementing control schemes In order to maintain at least the minimum $P_{INLET}$ 101, the BHP can be automatically controlled during a surface pump shut down process. For example, when the "make connection" mode is activated (e.g., either manually or automatically upon initiation of surface pump shutdown), the surface pumps (not shown) are stopped. The flow rate valve controller (90 in FIG. 4) may be instructed to maintain a selected $P_{INLET}$ to the right of the line 103. The suction pressure set point is continuously and automatically updated to reflect the current mud flow rate as measured by the flow meter 92. For example, if the subsea pump (AA in FIG. 4) slows at a faster rate than the surface pumps (not shown), the subsea pump (AA in FIG. 4) may be used to maintain the BHP by compensating for the loss of $P_{AFP}$. This embodiment of an automatically controlled shut down procedure is shown by as curve 104 in FIG. 6.

Alternatively, the loss of $P_{AFP}$ may be compensated for just prior to shutting down the surface pumps (not shown) by controlling the flow rate valve controller (90 in FIG. 4) to raise the inlet pressure ($P_{INLET}$) by a required suction pressure offset 105 to a selected offset pressure 106 before the surface pumps (not shown) are shut down to "make a connection." The offset pressure 106 value may be determined by a linear function relating a change in flow rate to a change in $P_{INLET}$ with respect to time. For example, one embodiment of a linear function relating the change in flow rate to the change in suction pressure over time is represented as a curve 107. In this embodiment, when the surface pumps (not shown) are shut down, $P_{INLET}$ follows the curve 107 so that, as the flow rate of the surface pumps (not shown) decreases in a controlled manner, the curve 107 to $P_{INLET}$ 101 required to maintain a substantially constant BHP at zero flow rate. Note that this control scheme must be carefully monitored because when $P_{INLET}$ is raised momentarily to the selected offset pressure 106, the BHP also increases accordingly, which may induce a risk of fracturing the formation in open hole intervals of the wellbore.

Another advantageous method would be to combine the two previously described methods by, for example, automatically raising $P_{INLET}$ by some small amount during drilling operations in anticipation of shutting down the surface pumps (not shown) to make a connection (e.g., this essentially involves creating a BHP "safety margin" a selected level above the formation pressure). Next, a control algorithm could be implemented (as described above) to automatically control BHP during surface pump shutdown. This method avoids a sudden increase in BHP that may be experienced when achieving the desired offset pressure 106.

Phase and Total Volume

Figure 7:
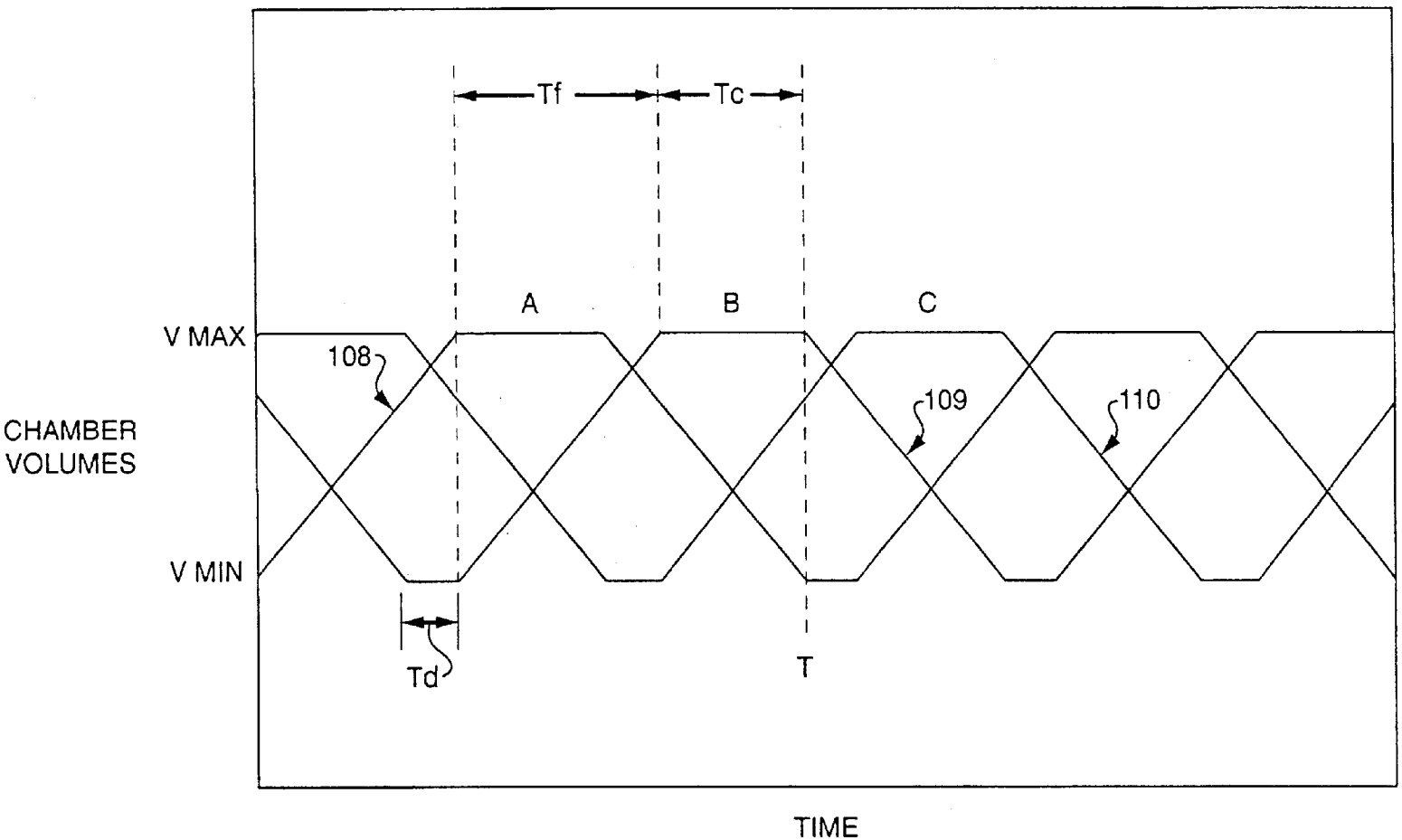
FIG. 7 shows a graph of mud chamber volumes in a triplex pump embodiment of the invention during stable operation.

FIG. 7 shows a diagram depicting time varying mud volumes in the mud chambers (2*a*, 2*b*, 2*c* in FIG. 1B) of the subsea pump (AA in FIG. 1B) (during, for example, steady state operation). Curves 108, 109, and 110 show depict mud volume in the mud chambers (2*a*, 2*b*, 2*c* in FIG. 1B) over time, respectively. Vmin represents a minimum volume of each mud chamber (2*a*, 2*b*, 2*c* in FIG. 1B), and Vmax represents a maximum volume of each mud chamber (2*a*, 2*b*, 2*c* in FIG. 1B). A last measured fill time for a mud chamber (2*b* in FIG. 1B) (where a fill cycle of the mud chamber (2*b* in FIG. 1B) is represented by curve 109) is represented by Tf, a compression time for the mud chamber (2*b* in FIG. 1B) is represented by Tc, and a decompression time for the mud chamber (2*b* in FIG. 1B) is represented by Td. Note that the diagram in FIG. 7 is idealized to the extent that the effect of volume change during compression and decompression are not considered. These effects have no effect on the idealized calculations because both compression and decompression times shown in FIG. 7 include "wait" times and thereby balance any small volumetric changes within a single cycle.

At time T, the mud volumes of the mud chamber (2*a*, 2*b*, 2*c* in FIG. 1B) are:

$$\text{Volume } 2a = V\min \tag{2}$$

$$\text{Volume } 2b = V\max \tag{3}$$

-continued $$\text{Volume } 2c = V\min + Tc\left(\frac{V\max - V\min}{Tf}\right) \tag{4}$$

where the volume of mud chamber 2*c* equals the minimum volume plus the elapsed time Tc multiplied by the slope of the curve 110. Equation (4) may be rewritten as:

$$\text{Volume } 2c = V\min + \frac{Tc}{Tf}(V\max - V\min) \tag{5}$$

and a total volume at time T can be expressed as:

$$\text{Total Volume at } T = Vt = V\min + \left(\frac{1 - Tc}{Tf}\right)V\min + \left(\frac{1 + Tc}{Tf}\right)V\max. \tag{6}$$

Moreover, phase (Φ) may be defined as a difference between the compression and the decompression times, normalized by the fill time:

$$\Phi = \frac{Tc - Td}{Tf}. \tag{7}$$

Further, because:

$$Tc + Td = Tf \tag{8}$$

then:

$$\Phi = 1 - \frac{Tc}{Tf}. \tag{9}$$

By substituting Equation (9) into Equation (6):

$$Vt = \frac{3}{2}(V\max + V\min) + \frac{\Phi}{2}(V\max - V\min) \text{ and} \tag{10}$$

$$\Phi = \frac{2Vt - 3(V\max - V\min)}{V\max - V\min}. \tag{11}$$

Accordingly, once the values of Vmin and Vmax are selected, there is a direct linear correlation between the steady state values of total volume (Vt) and phase (Φ). As long as the total volume in the system is being controlled during drilling operations, the pump cycle should not shift out of phase.

Measuring Mud Chamber Volume

In some embodiments, the pump diaphragm (4*a*, 4*b*, 4*c* in FIG. 1B) may be designed to "roll" along sides of the vessel (1*a*, 1*b*, 1*c* in FIG. 1B) when the diaphragms (4*a*, 4*b*, 4*c* in FIG. 1B) are displaced, contrasting with designs where diaphragms comprise tightly stretched membranes in which the volume displacement of the diaphragm is limited by the maximum allowable strain of the diaphragm material. The rolling of the diaphragms (4*a*, 4*b*, 4*c* in FIG. 1B) enables the pump elements (A, B, C in FIG. 1B) to have larger effective displacements (e.g., a higher percentage of the volume of the vessels (1*a*, 1*b*, 1*c* in FIG. 1B) can be displaced with each "stroke" of the diaphragm (4*a*, 4*b*, 4*c* in FIG. 1B)), and provides improved fatigue life for the diaphragms (4*a*, 4*b*, 4*c* in FIG. 1B), both of which are important aspects of some embodiments of the invention. For example, it has been determined that if the drilling mud being used in drilling operations is very compressible (e.g., the drilling mud includes entrained gas or volatile liquids), the diaphragm should be able to be fully stroked in the mud discharge direction to achieve a sufficient compression ratio to move the gas and/or volatile liquids through the pump without the pump becoming gas locked.

Some embodiments of the invention use diaphragm pump elements similar to diaphragm type pulsation dampers such as those disclosed in U.S. Pat. Nos. 2,757,689, 2,804,884, 3,169,551, 3,674,053, and 3,880,193, all assigned to the assignee of the present invention. The diaphragms disclosed in these references are generally in a fully "unfolded" position when a pump element is empty of drilling mud. Diaphragms according to these designs help avoid gas lock that may be caused by compressible fractions of drilling mud. Other embodiments comprise diaphragms such as those disclosed in U.S. Pat. No. 4,755,111, where a thickness of the diaphragm tapers from a thickest portion near edges of the diaphragm to a thinnest portion near a middle of the diaphragm. These diaphragms are stiffest in bending near the edges and less stiff near the middle, and this design encourages the diaphragm to roll back on itself (rather than simply bending back and forth) during displacement. Further, other types of diaphragms may be used with the invention, and the type of diaphragm is not intended to be limiting.

When rolling diaphragms are used in embodiments of the invention, volume measurement is complicated by the fact that the volume displaced by the diaphragm is a nonlinear function of the linear displacement of the diaphragm as measured by, for example, the diaphragm LDT. Further, because the diaphragm rolls differently depending upon the direction of displacement (e.g., when the pump element is either filling with mud or discharging mud), the function relating volume displacement to lineal displacement is "path dependent."

Figure 5:
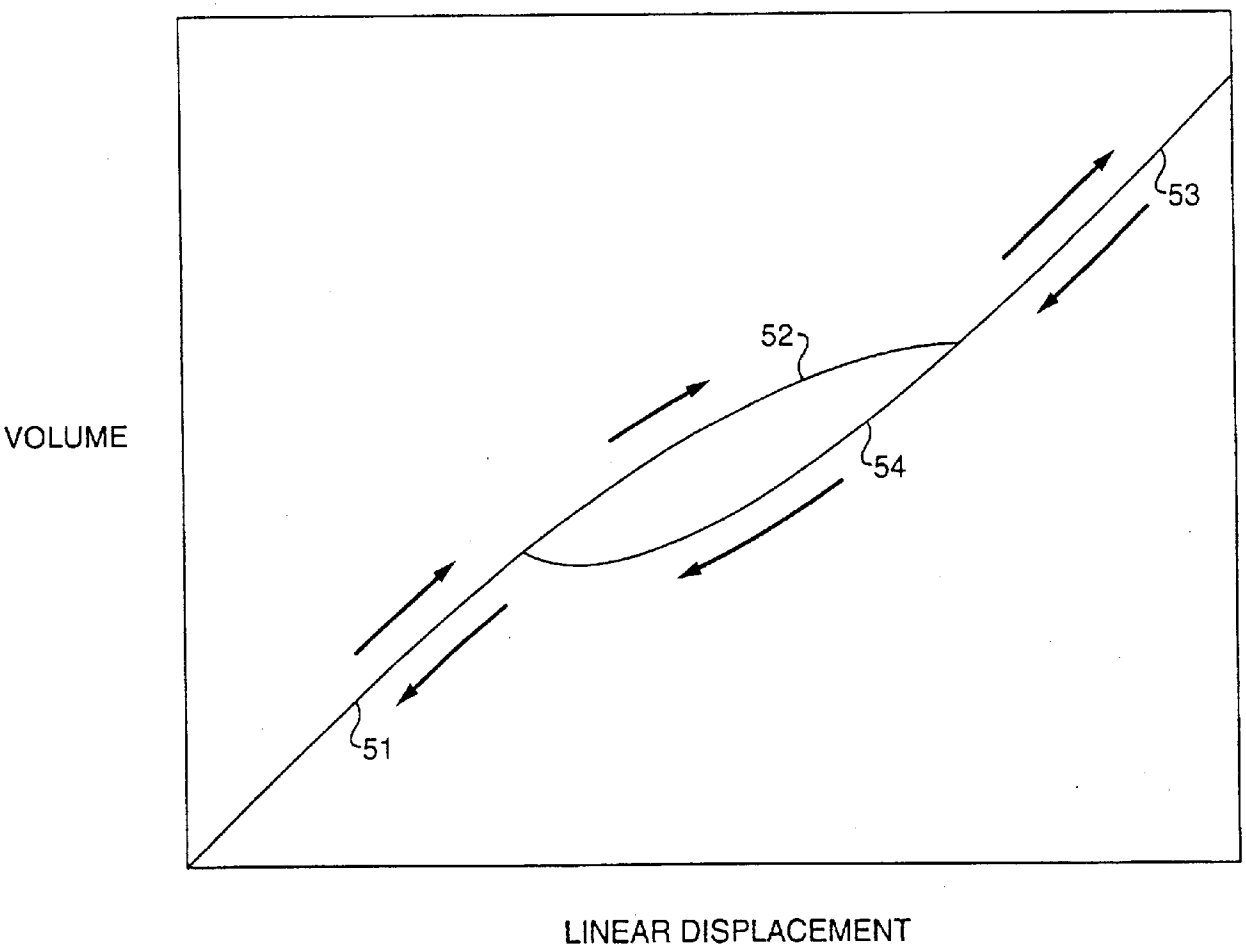
FIG. 5 shows a graph of mud chamber volume versus linear displacement of the pump diaphragm in an embodiment of the invention.

FIG. 5 shows a curve defining the relationship between volume displaced and linear displacement of the diaphragm (as measured by an LDT) for a nominal 20 gallon displacement diaphragm pump element (such as pump elements A, B, C in FIG. 1B). Note that a fill curve and an emptying curve diverge substantially proximate a middle of a stroke into path dependent functions. It has been determined that the path dependent curves are repeatable and that they can be reliably modeled mathematically with, for example, as few as four equations. The following discussion describes equations derived for four curves 51, 52, 53, 54 that model volume displaced versus linear displacement of the pump element diaphragm referenced above.

A lower substantially linear segment 51 may be modeled with the following equation:

$$y=1.75x-a \tag{12}$$

where "y" is a volume displaced, "x" is a linear displacement, and "a" is a coefficient related to an output of the LDT.

A nonlinear segment of a filling curve 52 may be expressed as:

$$y=0.085x^2+3x-b. \tag{13}$$

An upper substantially linear segment 53 may be expressed as:

$$y=1.4x-c. \tag{14}$$

Finally, a nonlinear segment of an emptying curve 54 may be modeled as:

$$y=0.125x-2.5x+d. \tag{15}$$

Note that "b," "c," and "d" are also coefficients related to the output of the LDT.

Modeling functions for other sizes of torispherical-type diaphragm pumping elements would be similar to equations (12)–(15) above, but the functions relating linear displacement to volume displaced for any size and type of rolling diaphragm pump element must generally be determined separately by empirically measuring the displaced volume per length of diaphragm stroke and fitting a function to the measured curve by, for example, regression or other curve fitting techniques known in the art. Moreover, other methods, such as look-up tables, may be used in determining instantaneous volume measurements. If, for example, linear piston-type pumps are used in embodiments of the invention, volume calculations are much simpler and are known in the art.

In practice, equations such as equations 51–54 may be used to calculate instantaneous mud chamber volumes. First, a determination must be made relating to whether the mud chamber is in a filling mode or a discharge mode. This determination may be made, in some embodiments, by evaluating a status of the mud discharge valves. For example, if the mud discharge valves (8*a*, 8*b*, 8*c* in FIG. 1B) are open, then the mud chambers (2*a*, 2*b*, 2*c* in FIG. 1B) are emptying, and the functions governing sections 53, 54, and 51 of the curve shown in FIG. 5 are applicable. If, in contrast, the mud discharge valves (8*a*, 8*b*, 8*c* in FIG. 1B) are closed, the mud chambers (2*a*, 2*b*, 2*c* in FIG. 1B) are filling, and the functions governing sections 51, 52, and 53 are applicable. The state of the mud discharge valves can be communicated from the sequencing devices (21*a*, 21*b*, 21*c* in FIG. 1B) to the pump volume totalizer (88 in FIGS. 4A and 4B) by the sequencing device data links (29*a*, 29*b*, 29*c* in FIG. 1B).

In some situations, differential pressure control may not be beneficial. In these situations, other embodiments of the invention may be used that do not control differential pressure, but that have other advantages. Using a slightly different control system and an additional sub-sea pump, a sub-sea mud pump and control system may operate to maintain a constant annulus pressure or a constant mud flow rate, or sub-sea mud pump may operate in a "make-up" mode. Further, some embodiments of the invention enable pumping mud in the mud return line back into the well bore. Some embodiments enable the clearing of a blockage in a pump system, in the piping of a pump system, or in a rock crusher, as will be described.

Figure 8A:
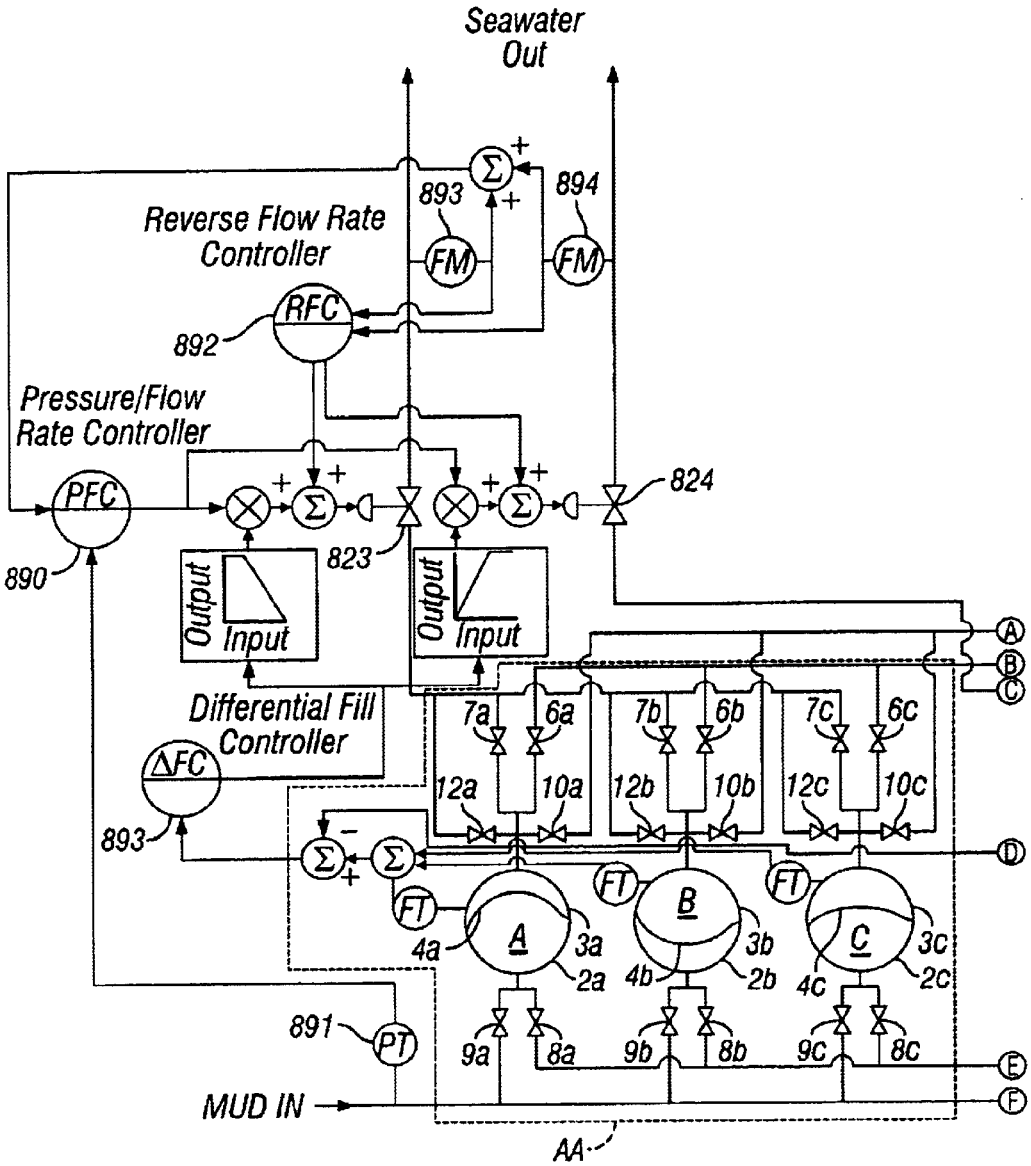
FIGS. 8A and 8B show an embodiment of a hydraulic control system and a pump system with a plurality of pumping units.
Figure 8B:
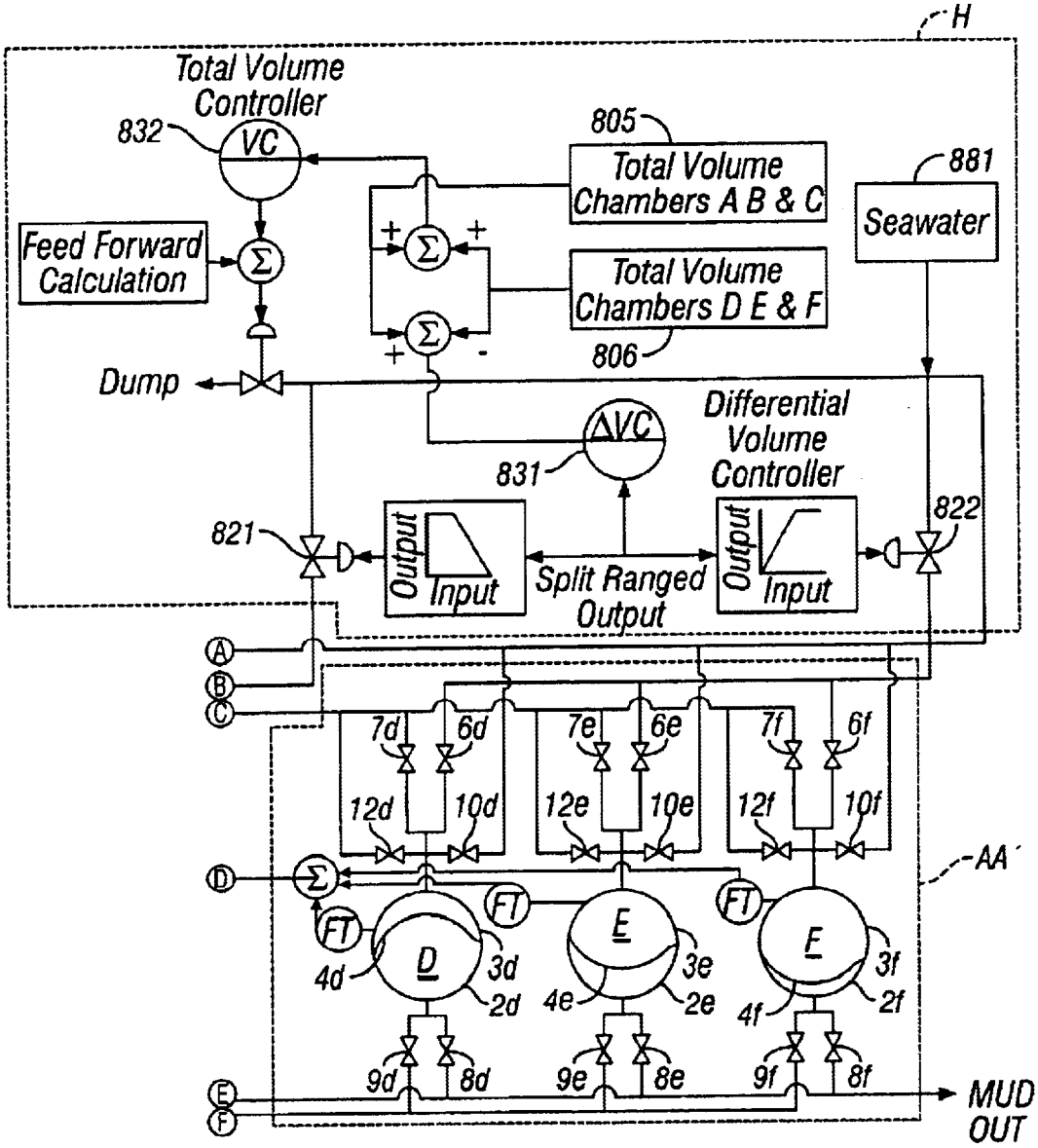

FIGS. 8A and 8B show one embodiment of a pump system 800 with two pumps AA, AA', each comprising a plurality of pumping elements A, B, C, D, E, F. The pumps AA, AA' may be referred to as "pumps" or "pump units." Pump elements A, B, and C are shown in pump AA, while pump elements D, E, and F are shown in pump AA'. Each pump may be considered a plurality of pumping elements. It will be understood that the pumps AA, AA' need not have an equivalent number of pumping elements, and they need not be triplex pumps. Those having ordinary skill in the art will be able to devise other arrangements of pumps and pumping elements without departing from the scope of the invention.

The pumps AA, AA' shown in FIGS. 8A and 8B operate substantially the same as pump AA shown in FIG. 1B. Further, the pumps AA, AA' may be operated using the same logic sequence described above.

FIGS. 8A and 8B also show a hydraulic control unit H. In one or more embodiments, the hydraulic control unit H may be adapted to control the pump units AA, AA' is certain operating modes. A hydraulic control unit may include one or more of a pump volume totalizers 805, 806, a total volume controller 832, a differential volume controller 831, differential volume control valves (or choke valves) 821, 822, a dump valve 811, and a hydraulic power source 881. The operation of each element in the hydraulic control system H will be explained in detail below.

Hydraulic fluid is pumped from the hydraulic power system 881 through a control system and into the pumping elements A, B, C, D, E, F. The control system includes a dump valve 811, two differential volume control valves 821, 822, a first pump volume totalizer 805, a second pump volume totalizer 806, and a total volume controller 832.

The pump volume totalizers 805, 806 may be similar to the volume totalizer 88 shown in FIG. 4A, and the totalizers 805, 806 may be operatively connected to diaphragm position transducers, similar to those shown in FIG. 1B (5*a*, 5*b*, 5*c*). The first pump volume totalizer 805 determines an instantaneous total volume of mud in the mud chambers 2*a*, 2*b*, 2*c* in pump AA. "$V_{ABC}$," as used herein, designates the instantaneous volume in pump AA. Likewise, the second pump volume totalizer 806 determines an instantaneous total volume of mud in the mud chambers 2*d*, 2*e*, 2*f* in pump AA'. "$V_{DEF}$," as used herein, designates the instantaneous volume in pump AA'.

The embodiment shown in FIGS. 8A and 8B includes two volume controllers, a total volume controller 832 and a differential volume controller 831. Their operation will now be described.

The total volume controller 832 determines an instantaneous total mud volume in the pump system 800. In the embodiment shown, the instantaneous total mud volume in the system ("$V_T$") is equal to $V_{ABC}+V_{DEF}$. The total volume controller 832 is operatively coupled to the dump valve 811. In one or more of the above described embodiments, a dump valve (e.g., 85 in FIG. 4A) is used to maintain a pressure differential between the hydraulic fluid inlet and the mud discharge. In the embodiment shown in FIGS. 8A and 8B, the dump valve 811 is used to maintain a constant instantaneous mud volume ($V_T$) in the pump system 800.

If the instantaneous mud volume ($V_T$) is smaller than desired, the total volume controller 832 operates the dump valve 811 to a more open position. A more open position of the dump valve 811 will cause a larger amount of hydraulic fluid to be dumped out of the pump system 800, thereby causing a corresponding increase in the instantaneous volume of mud ($V_T$). The dump valve 811 is located upstream of both volume choke valves (differential volume control valves) 821, 822, thus it affects the entire pump system 800.

Conversely, if the instantaneous mud volume ($V_T$) is larger than desired, the total volume controller 832 operates the dump valve 811 to a more closed position. A more closed position of the dump valve 811 will cause a smaller amount of hydraulic fluid to be dumped out of the pump system 800, thereby causing a corresponding decrease in the instantaneous volume of mud ($V_T$).

The embodiment of a pump system 800 shown in FIGS. 8A and 8B also includes a differential volume controller 831 that is operatively coupled to a first volume choke valve 821 and a second volume choke valve 822. The first volume choke valve 821 restricts the flow of hydraulic fluid into pump AA, and the second volume choke valve 822 restricts the flow of hydraulic fluid into pump AA'.

In a preferred embodiment, each pump AA, AA' operates in symmetry; that is, each pump AA, AA' operates at the same flow rate. The relative pump flow rates can be determined by a comparison of the instantaneous mud volume in each pump. Thus, at a preferred condition, $V_{ABC}$ is equal to $V_{DEF}$. In that situation, the differential volume ("$V_\delta$", which is equal to $V_{ABC}-V_{DEF}$) would equal zero. In some embodiments, the differential volume controller 831 outputs a signal that varies between 0% and 100%. When the differential volume ($V_\delta$) equals zero, the differential volume controller 831 may output a 50% signal. In some embodiments, the differential volume controller 831 is a reverse acting controller, thus an increase in the differential volume ($V_\delta$) will cause a decrease in the signal from the differential volume controller 831.

The volume choke valves 821, 822 may respond to the output signal of the differential volume controller 831. For example, in some embodiments, the first volume choke valve 821 is in a 100% open position when the differential volume controller signal is at 50% and when it is between 0% and 50%. When the differential volume controller signal is between 50% and 100% the first volume choke valve 821 may correspondingly vary between 100% open and 0% open. When the differential volume controller signal at 100% the first volume choke valve is 0% open.

In some embodiments, the second volume choke valve 822 operates in an opposite manner from the first volume choke valve 821. The second volume choke valve 822 is in a 100% open position when the differential volume controller signal is at 50% and when it is between 50% and 100%. When the differential volume controller signal is between 50% and 0% the second volume choke valve 822 may correspondingly vary between 100% open and 0% open. When the differential volume controller signal at 0% the first volume choke valve is 0% open.

If the pumping rate in pump AA becomes greater than the pumping rate in pump AA', that difference will be reflected in the mud volumes ($V_{ABC}$, $V_{DEF}$) of the pumps AA, AA'. An increase of the instantaneous mud volume of pump AA ($V_{ABC}$) will cause the differential volume ($V_\delta$) to become positive and the signal from the reverse acting differential volume controller 831 would drop below 50%. A signal below 50% may cause the second volume choke valve 822 to partially close, causing less hydraulic fluid to flow into pump AA' than into pump AA. The decrease in hydraulic fluid volume in pump AA' may cause the mud volume ($V_{DEF}$) in pump AA' to increase. Once the differential volume ($V_\delta$) returns to zero, the signal from the differential volume controller 831 may return to 50% and both volume choke valves 821, 822 will be 100% open.

Conversely, if the pumping rate in pump AA becomes greater than the rate in pump AA', the differential volume ($V_\delta$) to become negative and the signal from the reverse acting differential volume controller 831 would rise above 50%. A signal above 50% may cause the first volume choke valve 821 to partially close, causing less hydraulic fluid to flow into pump AA than into pump AA'. The decrease in hydraulic fluid volume in pump AA may cause the mud volume ($V_{ABC}$) in pump AA to increase. Once the differential volume ($V_\delta$) returns to zero, the signal from the differential volume controller 831 may return to 50% and both volume choke valves 821, 822 will be 100% open.

It is noted that if a persistent non-symmetry is present that favors one pump over the other, the differential volume controller 831 may continuously generate a signal above or below 50%. The signal will choke one side while leaving the other side fully open so that a continuous symmetry may be maintained.

Referring to FIGS. 8A and 8B, some embodiments include a pressure transducer 891 that measures the mud pressure in the annulus and communicates that pressure to a pressure-flow rate controller 890. The pressure-flow rate controller 890 may also be operatively coupled to two flow meters 893, 894 in the hydraulic discharge lines from the pump units AA, AA'. The pressure-flow rate controller 890, in turn, may control one or more hydraulic discharge valves. The embodiment shown in FIGS. 8A and 8B has a first hydraulic discharge valve 823 that regulates the flow of hydraulic fluid out of pump unit AA and a second hydraulic discharge valve 824 that regulates the flow of hydraulic fluid out of pump AA'.

The pressure-flow rate controller 890 may operate to maintain a constant mud pressure in the annulus, or the pressure-flow rate controller 890 may operate to maintain substantially equal hydraulic discharge rates from pump units AA, AA'. When the pressure-flow rate controller 890 operates to maintain a substantially constant mud pressure in the annulus, it operates the hydraulic discharge valves 823, 824 in the same direction. For example, if the pressure in the annulus begins to rise, the pressure-flow rate controller 890 may act to open both hydraulic discharge valves 823, 824, thereby increasing the pumping rate of the pump system 800 and decreasing the pressure in the annulus. Conversly, if the pressure in the annulus begins to drop, the pressure-flow rate controller 890 may act to close both hydraulic discharge valves 823, 824, thereby decreasing the pumping rate of the pump system 800 and increasing the pressure in the annulus.

In embodiments where the pressure-flow rate controller 890 operates to maintain substantially equal hydraulic discharge rates from each pump unit AA, AA', it restricts only one of the hydraulic discharge valves 823, 824. For example, if the hydraulic discharge from pump AA were greater than the hydraulic discharge rate from pump AA', the pressure-flow rate controller 890 would act to close hydraulic discharge valve 893 to a point where the hydraulic discharge rates were again equal. Likewise, if the hydraulic discharge from pump AA' were greater than the hydraulic discharge rate from pump AA, the pressure-flow rate controller 890 would act to close hydraulic discharge valve 894 to a point where the hydraulic discharge rates were again equal.

Those having ordinary skill in the art will realize that the pressure-flow rate controller 890 may be a reverse acting controller, similar to the differential volume controller 831, described above. The pressure-flow rate controller 890 signal may vary between 0% and 100% to control the hydraulic discharge valves 823, 824 to be between 0% open and 100 open, similar to the way that the differential flow rate controller 831 operates the volume choke valves 821, 822.

Sub sea pump AA may be used to pump mud into the annulus at a constant pressure when the drillstring is being removed. The mud in the mud return line may be pumped back into the annulus to make up for the volume of the drillstring that is being removed. By pumping mud into the annulus at a desired constant pressure, the bottom hole hydrostatic pressure may be maintained at a desired pressure to prevent fracturing of the formation or a kick from the formation.

For example, diaphragm pump element A in pump AA may be filled with mud from the mud return line by opening both the mud discharge valve 8*a* and the hydraulic outlet control valve 7*a*. The mud in the mud return line (not shown) will flow backwards through the mud discharge valve 8*a* and into the mud chamber 2*a*. The hydraulic fluid in the hydraulic fluid chamber 3*a* will flow out through the hydraulic outlet control valve 7*a*. This occurs because the higher density of the mud versus sea water creates a hydrostatic pressure in the mud return line that is greater than the ambient sea water pressure. Once the mud chamber 2*a* is filled with mud, the mud discharge valve 8*a* and the hydraulic outlet control valve 7*a* may be closed.

Once the valves 7*a*, 8*a* are closed, decompression control valve 12*a* may be opened to reduce the pressure in the hydraulic power chamber 3*a* and the mud chamber 2*a* from the mud return line pressure to a pressure near the wellbore pressure. This will prevent a shockwave from entering the wellbore when the mud suction valve 9*a* is opened.

The mud received in the mud chamber 2*a* may be pumped into the annulus (not shown) by opening the mud suction valve 9*a* and the hydraulic inlet control valve 6*a*. The hydraulic power system 881 may then be used to pump hydraulic fluid into the hydraulic power chamber 3*a* and force the mud in the mud chamber 2*a* out through the mud suction valve 9*a* and into the wellbore annulus. The hydraulic power system 881 may be controlled to output the desired pressure in the annulus. Once the mud chamber 2*a* is empty, the mud suction valve 9*a* and the hydraulic inlet control valve 6*a* are closed.

The compression control valve 10*a* may then be opened to raise the pressure in the chambers 2*a*, 3*a* to enable the opening of the mud discharge valve 8*a* and the hydraulic outlet control valve 7*a*. The process may then be repeated in diaphragm pump element A.

The same process may be used in the remaining diaphragm pump elements B, C in the sub sea pump AA to pump mud from the mud return line into the wellbore annulus. The operation in the three pump elements A, B, C may be staggered so that there is a continuous pumping of mud into the annulus at a constant pressure. The fill-up process requires less mud flow than normal operations, so the fill-up process may be performed using only one of the pumps AA, AA' in the pump system. Either pump AA, AA' may be used with the above described procedure.

Further, the same fill procedure may be used with a pump system that only includes one pump. For example, those having ordinary skill in the art, with the benefit if this disclosure, will be able to operate pump AA, as shown in FIG. 1B, to pump mud from the mud return line into the wellbore annulus.

Figure 9:
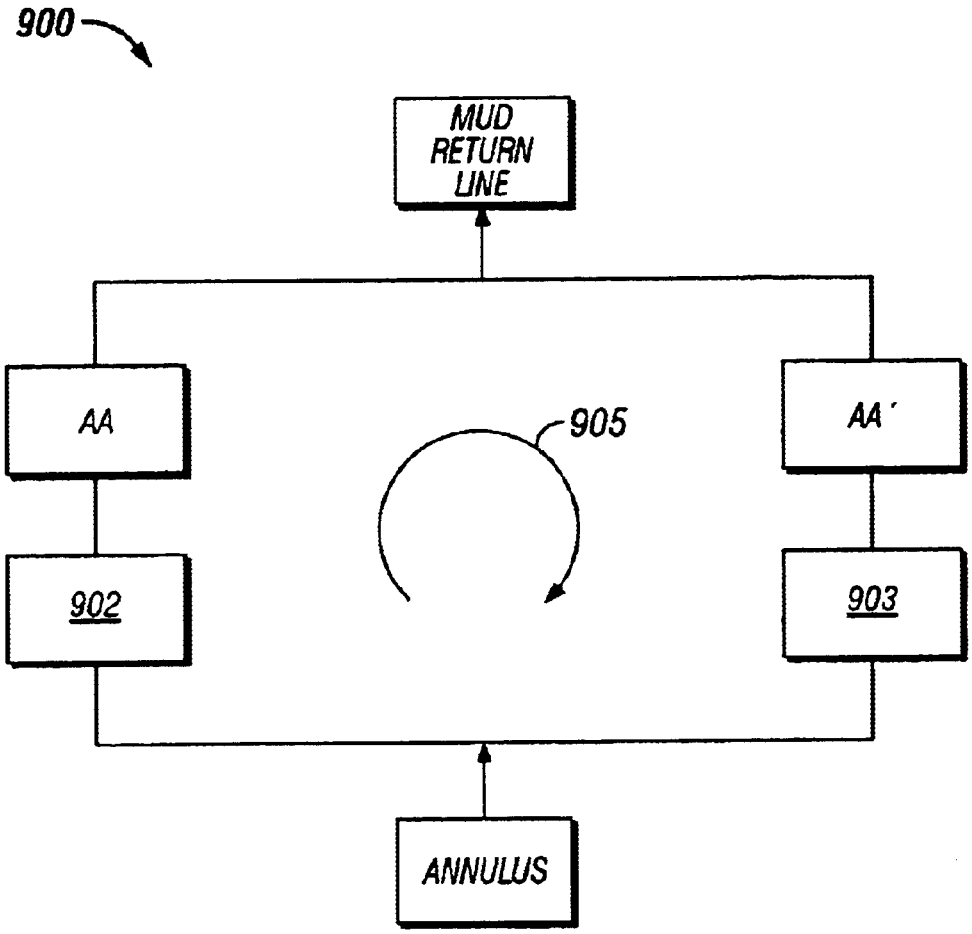
FIG. 9 shows a reverse flow path of a pump unit operating in reverse mode.

The embodiment of a mud pump system 800 shown in FIGS. 8A and 8B may also be used to clear a blockage in either of the pumps AA, AA'. FIG. 9 shows a diagram of the mud flow path 900 of a mud pump system, such as the one shown in FIGS. 8A and 8B. It is understood that the hydraulic and control features shown in FIGS. 8A and 8B, may also be present in system of FIG. 9, even though they are not specifically shown.

The mud flow path may contain two parallel flow paths, one comprising a rock crusher 902 and pump AA, and the other comprising a second rock crusher 903 and pump AA'. If for example, either rock crusher 903, piping proximate to pump AA', or pump AA' becomes clogged with formation cuttings present in the mud drawn in from the annulus, it may become necessary to clear the blockage. The blockage may be cleared by operating pump AA' in reverse, in the manner described above relating to filling the annulus when the drill string is removed. Pump AA' may be operated in reverse until the blockage is cleared. If the blockage occurs at a time when it is undesirable to pump mud into the annulus, the unclogged pump, pump AA, may be operated in normal mode at the same time that pump AA' is operated in reverse to prevent mud from flowing into the annulus.

In some embodiments, when a blockage is being cleared from pump AA', the piping in or near pump AA', or rock crusher 903, the first volume choke valve (821 in FIG. 8B) is restricted to less than 100% open while the second choke valve (822 in FIG. 8B) remains 100% open. This configuration will enable a higher pumping rate in pump AA than in pump AA'. A circulation loop 905 will be created between pumps AA and AA', and the greater pumping rate of pump AA will enable mud to still be withdrawn from annulus and pumped into the mud return line. Typically, the overall pumping rate will be lower than is required for normal drilling. Thus, drilling operations may have to be slowed when a blockage is being cleared.

Further, by using a pressure transducer on the mud inlet (891 in FIG. 8A), a pressure controller (890 in FIG. 8A), and a hydraulic discharge valve (823 in FIG. 8A), the pressure in the annulus may be maintained at a desired constant pressure while a blockage is being cleared.

In some embodiments, when a blockage is being cleared, for example from the piping or rock crusher 903 proximate pump AA', the other pump AA will be operated in the forward direction at the same pumping rate as pump AA'. In these embodiments, the drilling operations may be stopped while the blockage is being cleared.

Those having ordinary skill in the art will realize that a blockage in pump AA could be cleared using the same process described above, but operating pump AA in reverse and pump AA' in normal mode.

Moreover, a blockage clearing procedure may be performed while the pump is in make-up mode, as described above. Because make-up mode requires a lower flow rate, the forward operating pump may pump the reverse flow from another pump while still operating the pump system in make-up mode. One or more embodiments of the invention enable a blockage clearing operation to be performed for each pump in a pump system while additional sections of pipe are being added at the surface. Once the blockage is cleared, normal pumping and drilling operations may proceed.

In some embodiments, a pump system 800 includes a reverse flow rate controller 892. The reverse flow rate controller 892 may be operatively connected to the flow meters 893, 894. The reverse flow meter 892 regulates the hydraulic discharge rates when one or more of the pump units AA, AA' are operated in reverse mode. For example, if pump AA is operated in a reverse more to clear a blockage, the reverse flow meter 892 controls the hydraulic discharge valves 823, 824 to maintain a desired relative flow rate. For example, in some embodiments, the reverse flow rate controller operates the hydraulic discharge valves so that the hydraulic discharge rate from pump unit AA, operating in reverse mode, is substantially the same as the hydraulic discharge rate from pump AA', operating in normal mode. In some embodiments, the reverse flow rate controller operates the hydraulic discharge valves so that the hydraulic discharge rate from pump unit AA, operating in reverse mode, is lower than the hydraulic discharge rate from pump AA', operating in normal mode. In these embodiments, pump AA' is able to pump the returns from pump AA and still pump mud from the annulus into the mud return line.

Advantageously, one or more embodiments of the present invention enable symmetrical pumping through more than one pump unit in a pumping system. The pump may be operated to maintain a constant flow rate or a constant pressure in the annulus, or the pump system may be operated in make-up mode.

Advantageously, one or more embodiments enable a pump or a pump system to operate in reverse to pump mud in the mud return line back into the wellbore to make up for the volume of the drillstring as it is withdrawn. A pump or pump system may be operated to maintain the pressure in the top of the annulus so that the hydrostatic pressure near the bottom of the wellbore also remains constant as the drillstring is withdrawn.

Advantageously, one or more embodiments of a pump system enable a blockage in a pump or rock crusher to be cleared by operating the clogged pump in reverse while another pump operates in normal more to maintain the mud pressure in the annulus.

Thus, one or more embodiments of the invention enable a single sub-sea pumping unit to operate normally in a variety of modes, to pump mud from the mud return line into the annulus at a constant pressure, and to clear blockages in the pumps. No additional pump units or other submersible equipment are necessary.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A pump system, comprising:

a plurality of pump units, each pump unit comprising a plurality of pumping elements, each pumping element comprising a pressure vessel with a first and a second chamber therein, a separating member disposed between the first and second chambers, a measurement device configured to measure the volume of at least one of the first and second chambers, a hydraulic inlet control valve and a hydraulic outlet control valve coupled to the first chamber, a mud suction valve and a mud discharge valve coupled to the second chamber, the first chamber being hydraulically coupled to receive and discharge a hydraulic fluid, the second chamber being hydraulically coupled to receive and discharge a drilling fluid, wherein the separating member is configured to move within the pressure vessel in response to a pressure differential between the first and second chambers; and a hydraulic control unit adapted to control the plurality of pump units.

2. The pump system of claim 1, wherein the plurality of pump units comprises a first pump unit and a second pump unit, and wherein the hydraulic control unit comprises a hydraulic power source, a dump valve, a first pump volume totalizer operatively coupled to the measurement devices in the plurality of pumping elements of the first pump unit, a second pump volume totalizer operatively coupled to the measurement devices in the plurality of pumping elements of the second pump unit, and a total volume controller operatively coupled to the first pump volume totalizer and the second pump volume totalizer and adapted to control the dump valve to maintain a constant mud volume in the pump system.

3. The pump system of claim 2, further comprising a differential volume controller operatively coupled to the first pump volume totalizer and to the second pump volume totalizer, and adapted to control a first differential volume control valve operatively coupled to the first pump unit and a second differential volume control valve operatively coupled to the second pump unit so that a pumping rate of the first pump unit and a pumping rate of the second pump unit are regulated by the differential volume controller.

4. The pump system of claim 2, further comprising a pressure transducer adapted to measure a pressure in a wellbore annulus, a hydraulic discharge control valve adapted to control a rate of hydraulic fluid discharge, and a fill pressure controller operatively coupled to the pressure transducer and adapted to control the hydraulic discharge control valve to maintain a substantially constant pressure in the wellbore annulus.

5. The pump system of claim 1, wherein the hydraulic control unit is adapted to operate the hydraulic inlet control valves, the hydraulic outlet control valves, the mud suction valves, and the mud discharge valves in at least one of the plurality of pump units so that a first pump unit of the plurality of pump units is configured to pump mud in a reverse direction.

6. The pump system of claim 5, wherein the hydraulic control unit is configured to operate a second pump unit of the plurality of pump units in a normal mode while operating the first pump unit in a reverse direction.

7. The pump system of claim 5, further comprising a hydraulic discharge control valve adapted to control a rate of hydraulic fluid discharge, a flow meter configured to monitor the rate of hydraulic fluid discharge, and a fill pressure controller operatively coupled to the flow meter and adapted to control the hydraulic discharge control valve to maintain a desired rate of hydraulic fluid discharge.

8. A pump system, comprising:

a plurality of pump units, each pump unit configured to receive and discharge a hydraulic fluid and a drilling fluid; and a hydraulic control unit configured to control the plurality of pump units comprising a hydraulic power source configured to supply the hydraulic fluid to the plurality of pump units, a dump valve, a plurality of pump volume totalizers, each pump volume totalizer being operatively coupled to one of the pump units of the plurality of pump units, and a total volume controller operatively coupled to the plurality of pump volume totalizers and configured to control the dump valve to maintain a constant volume of the drilling fluid in the pump system.

9. The pump system of claim 8, wherein the hydraulic control unit further comprises a differential volume controller operatively coupled to the plurality of pump volume totalizers, and a plurality of differential volume control valves, each differential volume control valve operatively coupled to a pump unit of the plurality of pump units, wherein the differential volume controller is configured to control the plurality of differential volume control valves so that pumping rates of the plurality of pump units are regulated by the differential volume controller.

10. The pump system of claim 8, wherein each pump unit of the plurality of pump units comprises a plurality of pumping elements, each pumping element comprising a pressure vessel with a first and a second chamber therein, a separating member disposed between the first and second chambers, a measurement device configured to measure the volume of at least one of the first and second chambers, a hydraulic inlet control valve and a hydraulic outlet control valve coupled to the first chamber, a mud suction valve and a mud discharge valve coupled to the second chamber, the first chamber being hydraulically coupled to receive and discharge the hydraulic fluid, the second chamber being hydraulically coupled to receive and discharge the drilling fluid, wherein the separating member is configured to move within the pressure vessel in response to a pressure differential between the first and second chambers.

11. The pump system of claim 10, further comprising a pressure transducer operatively coupled to at least one of the plurality of pump units and configured to measure a pressure in a wellbore annulus, a hydraulic discharge control valve configured to control a rate of hydraulic fluid discharge, and a fill pressure controller operatively coupled to the pressure transducer and configured to control the hydraulic discharge control valve to maintain a substantially constant pressure in the wellbore annulus.

12. The pump system of claim 11, wherein the hydraulic control unit is configured to operate the hydraulic inlet control valves, the hydraulic outlet control valves, the mud suction valves, and the mud discharge valves in at least one of the plurality of pump units so that a first pump unit of the plurality of pump units is configured to pump mud in a reverse direction.

13. The pump system of claim 12, further comprising a plurality of flow meters operatively coupled to the hydraulic discharge control valve and configured to monitor the rate of hydraulic fluid discharge, and a fill pressure controller operatively coupled to at least one of the plurality of flow meters and configured to control the hydraulic discharge control valve to maintain a desired rate of hydraulic fluid discharge while the first pump is operated in the reverse direction.

14. The pump system of claim 12, wherein the hydraulic control unit is configured to operate a second pump unit of the plurality of pump units in a normal mode while operating the first pump unit in a reverse direction.

15. A method for maintaining a desired mud volume in a pump system having a plurality of pump units, comprising:

measuring a total volume of hydraulic fluid present in the plurality of pump units;

determining a total volume of drilling mud present in the pump system dependent on the total volume of hydraulic fluid;

if the total volume of drilling mud is greater than the desired mud volume, pumping hydraulic fluid through a hydraulic control unit into the plurality of pump units such that the total volume of drilling mud present in the pump system is decreased to the desired mud volume; and if the total volume of drilling mud is less than the desired mud volume, discharging hydraulic fluid from the plurality of pump units through the hydraulic control unit such that the total volume of drilling mud present in the pump system is increased to the desired mud volume, wherein the hydraulic control unit is configured to control a first flow rate of hydraulic fluid into the plurality of pump units and to control a second flow rate of hydraulic fluid from the plurality of pump units.

16. The method of claim 15, wherein each pump unit of the plurality of pump units comprises a plurality of pumping elements, each pumping element comprising a pressure vessel with a first and a second chamber therein, a separating member disposed between the first and second chambers, a measurement device configured to measure the volume of at least one of the first and second chambers, a hydraulic inlet control valve and a hydraulic outlet control valve coupled to the first chamber, a mud suction valve and a mud discharge valve coupled to the second chamber, the first chamber being hydraulically coupled to receive and discharge the hydraulic fluid, the second chamber being hydraulically coupled to receive and discharge the drilling fluid, wherein the separating member is configured to move within the pressure vessel in response to a pressure differential between the first and second chambers.

17. The method of claim 16, wherein the total volume of hydraulic fluid is measured by determining position displacements of the separating members disposed within the plurality of pump units.

18. The method of claim 15, wherein the hydraulic control unit comprises a hydraulic power source adapted to supply the hydraulic fluid to the plurality of pump units, a dump valve configured to discharge the hydraulic fluid from the plurality of pump units, a plurality of pump volume totalizers, each pump volume totalizer being operatively coupled to one of the pump units of the plurality of pump units and configured to determine a total volume of mud present in the pump unit, and a total volume controller operatively coupled to the plurality of pump volume totalizers and configured to control the first flow rate and the second flow rate.

19. The method of claim 18, wherein the hydraulic control unit further comprises a differential volume controller operatively coupled to the plurality of pump volume totalizers, and a plurality of differential volume control valves, each differential volume control valve operatively coupled to a pump unit of the plurality of pump units, wherein the differential volume controller is configured to control the plurality of differential volume control valves so that pumping rates of the plurality of pump units are regulated by the differential volume controller.

20. The method of claim 19, wherein, dependent on the differential volume controller, the hydraulic control unit is configured to operate the hydraulic inlet control valves, the hydraulic outlet control valves, the mud suction valves, and the mud discharge valves in at least one of the plurality of pump units so that a first pump unit of the plurality of pump units is configured to pump mud in a reverse direction.

21. The method of claim 20, wherein the pumping mud in a reverse direction comprises:

measuring a pressure in a wellbore annulus of the pump system;

dependent on the pressure in the wellbore annulus, discharging hydraulic fluid from the first pump unit through a hydraulic discharge control valve configured to control a rate of hydraulic fluid discharge; and controlling the rate of hydraulic fluid discharge from the first pump unit to maintain a desired rate of hydraulic fluid discharge from the pump system.

22. The method of claim 21, wherein the pump system further comprises a pressure transducer operatively coupled to at least one of the plurality of pump units and configured to measure the pressure in the wellbore annulus, a plurality of flow meters operatively coupled to the hydraulic discharge control valve and configured to monitor the rate of hydraulic fluid discharge, and a fluid pressure controller operatively coupled to the pressure transducer and at least one of the plurality of flow meters and configured to control the hydraulic discharge control valve.

23. The method of claim 20, wherein the hydraulic control unit is configured to operate a second pump unit of the plurality of pump units in a normal mode while operating the first pump unit in a reverse direction.

* * * * *